US005987779A

United States Patent [19]

Litchfield et al.

[11] Patent Number: 5,987,779

[45] Date of Patent: Nov. 23, 1999

[54] ATHLETIC SHOE HAVING INFLATABLE BLADDER

[75] Inventors: Paul E. Litchfield, Westborough, Mass.; Peter M. Foley, Minnetonka, Minn.; Steven Burris, Atrzogenaurach, Germany; Steven F. Smith, Taunton, Mass.; Matthew L. Phillips, North Easton, Mass.; David J. Lacorazza, Quincy, Mass.

[73] Assignee: Reebok International Ltd., Stoughton, Mass.

[21] Appl. No.: 08/632,800

[22] Filed: Apr. 17, 1996

Related U.S. Application Data

[63] Continuation-in-part of application No. 08/370,189, Jan. 9, 1995, and application No. 08/434,755, May 4, 1995, said application No. 08/370,189, is a continuation of application No. 08/162,961, Dec. 8, 1993, abandoned, which is a continuation of application No. 07/857,493, Mar. 25, 1992, abandoned, which is a continuation of application No. 07/588,828, Sep. 27, 1990, Pat. No. 5,113,599, which is a continuation of application No. 07/530,854, May 30, 1990, abandoned, which is a continuation-in-part of application No. 07/307,566, Feb. 8, 1989, abandoned, which is a continuation-in-part of application No. 07/089,749, Aug. 27, 1987, abandoned, said application No. 08/434,755, is a continuation of application No. 08/208,787, Mar. 11, 1994, abandoned, which is a continuation of application No. 07/828,443, Jan. 31, 1992, abandoned.

[51] Int. Cl.[6] ..... A43B 13/20; A43B 7/14

[52] U.S. Cl. ..... 36/29; 36/93

[58] Field of Search ..... 36/93, 29, 71, 36/88, 28, 139

[56] References Cited

U.S. PATENT DOCUMENTS

| | | | |
|---|---|---|---|
| D. 246,486 | 11/1977 | Nickel | D2/318 |
| D. 302,764 | 8/1989 | Peoples et al. | D2/264 |
| D. 307,508 | 5/1990 | Miller et al. | D2/314 |
| D. 309,211 | 7/1990 | Nakagawa | D2/318 |
| 508,034 | 11/1893 | Moore | 36/29 |
| 510,504 | 12/1893 | Foster | 36/29 |
| 545,705 | 9/1895 | MacDonald | 36/29 X |
| 547,645 | 10/1895 | LaCroix | 36/29 |
| 566,422 | 8/1896 | Singleton | 36/29 |
| 580,501 | 4/1897 | Mobberley | 36/29 |

(List continued on next page.)

FOREIGN PATENT DOCUMENTS

| | | | |
|---|---|---|---|
| 8305004 | 4/1985 | Brazil . | |
| 1 143 938 | 4/1983 | Canada . | |
| 1 230 225 | 12/1987 | Canada . | |
| 0 229 273 | 7/1987 | European Pat. Off. . | |
| 0 389 215 | 9/1990 | European Pat. Off. . | |
| 0472110 | 2/1992 | European Pat. Off. | 36/29 |
| 629360 | 12/1994 | European Pat. Off. | 36/29 |
| 720 257 | 2/1932 | France . | |
| 2 026 062 | 4/1969 | France . | |
| 2 180 315 | 11/1973 | France . | |
| 2 356 384 | 1/1978 | France . | |
| 2 496 423 | 6/1982 | France | 36/93 |

(List continued on next page.)

*Primary Examiner*—B. Dayoan

*Attorney, Agent, or Firm*—Sterne, Kessler, Goldstein & Fox P.L.L.C.

[57] ABSTRACT

An athletic shoe is described, provided with an inflatable tongue or bladder for a more secure fit to the user's foot. The bladder may include a plurality of chambers with a valve disposed therebetween to selectively inflate the chambers. The inflatable tongue or bladder has a lightweight pump disposed thereon. Inflatable footwear having an inflation bag under the foot is also disclosed. The inflation bag is formed by two sheets of material that are welded together. Interior welds are provided to moderate the thickness of the inflation bag. A foam layer having apertures is positioned adjacent to the inflation bag. The apertures overlie the interior welds and are sized larger than the interior welds. Also described is a slider valve that enables selective inflation of individual bladder chambers.

20 Claims, 33 Drawing Sheets

U.S. PATENT DOCUMENTS

| | | | |
|---|---|---|---|
| 586,155 | 7/1897 | Bascom | 36/29 |
| 692,170 | 1/1902 | Wallerstein et al. . | |
| 806,267 | 12/1905 | King . | |
| 850,327 | 4/1907 | Tauber | 36/29 |
| 900,867 | 10/1908 | Miller | 36/29 |
| 950,333 | 2/1910 | Koch . | |
| 1,059,485 | 4/1913 | Orlapp . | |
| 1,069,001 | 7/1913 | Guy | 36/29 |
| 1,145,534 | 7/1915 | Wetmore . | |
| 1,148,376 | 7/1915 | Gay | 36/29 |
| 1,184,013 | 5/1916 | Pierce . | |
| 1,193,608 | 8/1916 | Poulson | 36/29 |
| 1,216,795 | 2/1917 | Gause . | |
| 1,241,832 | 10/1917 | Druckenmiller . | |
| 1,285,695 | 11/1918 | Harman | 137/620 |
| 1,304,915 | 5/1919 | Spinney | 36/29 |
| 1,328,154 | 1/1920 | Jackerson | 36/29 |
| 1,383,067 | 6/1921 | Borman . | |
| 1,498,838 | 6/1924 | Harrison, Jr. | 36/29 |
| 1,605,985 | 11/1926 | Rasmussen | 36/29 X |
| 1,954,122 | 4/1934 | Fiori | 36/88 X |
| 1,979,972 | 11/1934 | Guild | 36/29 |
| 2,007,803 | 7/1935 | Kelly | 36/29 X |
| 2,020,240 | 11/1935 | Cochran | 36/29 X |
| 2,074,289 | 3/1937 | Sullivan . | |
| 2,080,469 | 5/1937 | Gilbert | 36/29 |
| 2,080,499 | 5/1937 | Nathansohn | 36/29 |
| 2,177,116 | 10/1939 | Persichino . | |
| 2,488,382 | 11/1949 | Davis . | |
| 2,532,742 | 12/1950 | Stoiner | 36/35 |
| 2,600,239 | 6/1952 | Gilbert . | |
| 2,605,560 | 8/1952 | Gouabault | 36/29 |
| 2,638,690 | 5/1953 | Bullard, III . | |
| 2,677,904 | 5/1954 | Reed | 36/29 |
| 2,677,906 | 5/1954 | Reed | 36/29 |
| 2,682,712 | 7/1954 | Owsen et al. | 36/29 X |
| 2,762,134 | 9/1956 | Taun | 36/44 X |
| 2,774,152 | 12/1956 | Alber . | |
| 2,863,230 | 12/1958 | Cortina | 36/29 |
| 3,027,659 | 4/1962 | Gianola . | |
| 3,044,190 | 7/1962 | Urbany | 36/29 |
| 3,120,712 | 2/1964 | Menken | 36/29 |
| 3,180,039 | 4/1965 | Burns, Jr. . | |
| 3,211,164 | 10/1965 | Bender et al. | 137/625.48 |
| 3,225,463 | 12/1965 | Burnham | 36/29 X |
| 3,273,263 | 9/1966 | Klima . | |
| 3,372,495 | 3/1968 | Finn | 36/93 |
| 3,410,004 | 11/1968 | Finn . | |
| 3,664,043 | 5/1972 | Polumbus, Jr. | 36/54 |
| 3,685,176 | 8/1972 | Rudy | 36/71 |
| 3,716,930 | 2/1973 | Brahm | 36/3 B |
| 3,721,265 | 3/1973 | Hoffland | 137/625.47 |
| 3,738,024 | 6/1973 | Matsuda | 36/29 X |
| 3,744,159 | 7/1973 | Nishimura | 36/71 X |
| 3,765,422 | 10/1973 | Smith | 123/594 |
| 3,791,375 | 2/1974 | Pfeiffer | 36/137 X |
| 3,795,994 | 3/1974 | Ava | 36/29 |
| 3,854,228 | 12/1974 | Conroy | 36/71 |
| 3,888,242 | 6/1975 | Harris et al. | 128/64 |
| 3,973,336 | 8/1976 | Ahn | 36/3 B |
| 3,985,155 | 10/1976 | Nightingale | 137/625.47 |
| 3,993,099 | 11/1976 | Nightingale | 137/625.47 |
| 4,039,039 | 8/1977 | Gottfried | 128/87 R |
| 4,083,127 | 4/1978 | Hanson | 36/93 |
| 4,100,686 | 7/1978 | Sgarlato et al. | 36/29 |
| 4,106,222 | 8/1978 | Houck | 36/29 |
| 4,123,855 | 11/1978 | Thedford | 36/44 |
| 4,129,951 | 12/1978 | Petrosky | 36/29 |
| 4,178,013 | 12/1979 | Bataille | 36/119 X |
| 4,183,156 | 1/1980 | Rudy | 36/29 X |
| 4,211,236 | 7/1980 | Krinsky | 128/594 |
| 4,217,705 | 8/1980 | Donzis | 36/29 |
| 4,219,945 | 9/1980 | Rudy | 36/29 |
| 4,232,459 | 11/1980 | Vaccari | 36/71 |
| 4,236,725 | 12/1980 | Bataille | 36/93 |
| 4,271,606 | 6/1981 | Rudy | 36/29 |
| 4,297,755 | 11/1981 | Mollura | 5/455 |
| 4,316,335 | 2/1982 | Giese et al. | 36/28 X |
| 4,340,626 | 7/1982 | Rudy | 36/29 X |
| 4,342,157 | 8/1982 | Gilbert | 36/29 |
| 4,372,297 | 2/1983 | Perlin | 128/64 |
| 4,397,104 | 8/1983 | Doak | 36/29 |
| 4,417,407 | 11/1983 | Fukuoka | 36/3 B |
| 4,446,634 | 5/1984 | Johnson et al. | 36/29 |
| 4,458,429 | 7/1984 | Schmid | 36/3 R |
| 4,458,430 | 7/1984 | Peterson | 36/28 |
| 4,462,171 | 7/1984 | Whispell | 36/3 B |
| 4,571,853 | 2/1986 | Medrano | 36/43 |
| 4,571,995 | 2/1986 | Timme | 73/199 |
| 4,583,305 | 4/1986 | Miyamoto | 36/119 |
| 4,610,099 | 9/1986 | Signori | 36/29 X |
| 4,628,945 | 12/1986 | Johnson, Jr. | 128/80 H |
| 4,631,843 | 12/1986 | Annovi | 36/119 |
| 4,649,552 | 3/1987 | Yukawa | 36/132 X |
| 4,654,986 | 4/1987 | George | 36/119 |
| 4,662,087 | 5/1987 | Beuch | 36/93 X |
| 4,670,995 | 6/1987 | Huang | 36/29 |
| 4,694,520 | 9/1987 | Paul et al. | 5/453 |
| 4,700,403 | 10/1987 | Vacanti | 36/71 X |
| 4,702,022 | 10/1987 | Porcher | 36/119 |
| 4,712,316 | 12/1987 | Baggio | 36/119 |
| 4,730,403 | 3/1988 | Walkhoff | 36/93 X |
| 4,763,426 | 8/1988 | Polus et al. | 36/29 |
| 4,779,359 | 10/1988 | Famolare, Jr. | 36/29 |
| 4,805,601 | 2/1989 | Eischen, Sr. | 128/64 |
| 4,823,482 | 4/1989 | Lakic | 36/119 X |
| 4,852,274 | 8/1989 | Wilson | 36/29 |
| 4,856,208 | 8/1989 | Zaccaro | 36/29 |
| 4,874,640 | 10/1989 | Donzis | 36/37 X |
| 4,877,057 | 10/1989 | Christensen | 137/625.48 |
| 4,887,367 | 12/1989 | Mackness et al. | 36/29 X |
| 4,906,502 | 3/1990 | Rudy | 36/43 X |
| 4,912,861 | 4/1990 | Huang | 36/29 |
| 4,991,317 | 2/1991 | Lakic | 36/44 |
| 4,995,124 | 2/1991 | Wridge, Jr. et al. | 5/450 |
| 4,995,173 | 2/1991 | Spier | 36/29 |
| 4,999,932 | 3/1991 | Grim | 36/88 |
| 5,025,575 | 6/1991 | Lakic | 36/44 |
| 5,060,694 | 10/1991 | Florida et al. | 137/625.18 |
| 5,074,765 | 12/1991 | Pekar | 36/29 X |
| 5,113,599 | 5/1992 | Cohen et al. | 36/88 |
| 5,230,249 | 7/1993 | Sasaki et al. | 73/714 |
| 5,406,719 | 4/1995 | Potter | 36/28 |

FOREIGN PATENT DOCUMENTS

| | | | |
|---|---|---|---|
| 820 869 | 9/1951 | Germany . | |
| 2 321 817 | 11/1973 | Germany . | |
| 28 00 359 | 7/1979 | Germany . | |
| 3245182 | 5/1983 | Germany | 36/134 |
| 8802338 | 8/1989 | Germany . | |
| 95419 | 2/1988 | Taiwan . | |
| 23547 | of 1800 | United Kingdom . | |
| 26637 | of 1897 | United Kingdom . | |
| 338 266 | 12/1930 | United Kingdom . | |
| 817 521 | 7/1959 | United Kingdom . | |
| 2 039 717 | 8/1980 | United Kingdom . | |
| 14955 | 6/1994 | United Kingdom . | |
| 87/03789 | 7/1987 | WIPO | 36/93 |
| WO 87/03789 | 7/1987 | WIPO . | |
| 89/10074 | 11/1989 | WIPO . | |
| WO 90/04323 | 5/1990 | WIPO . | |
| WO 91/18527 | 12/1991 | WIPO . | |
| 93/14 659 | 8/1993 | WIPO . | |
| 9314659 | 8/1993 | WIPO | 36/29 |

WO 93/21790 11/1993 WIPO .

ATHLETIC SHOE HAVING INFLATABLE BLADDER

CROSS REFERENCES TO RELATED APPLICATIONS

This application is a continuation-in-part of U.S. application Ser. No. 08/370,189 filed Jan. 9, 1995 and a continuation-in-part of U.S. application Ser. No. 08/434,755, filed May 4, 1995. U.S. application Ser. No. 08/370,189 is a continuation of U.S. application Ser. No. 08/162,961, filed Dec. 8, 1993, now abandoned, which is a continuation of U.S. application Ser. No. 07/857,493, filed Mar. 25, 1992, now abandoned, which is a continuation of U.S. application Ser. No. 07/588,828, filed Sep. 27, 1990, now U.S. Pat. No. 5,113,599, which is a continuation of U.S. application Ser. No. 07/530,854, filed May 30, 1990, now abandoned, which is a continuation-in-part of U.S. application Ser. No. 07/307,566, filed Feb. 8, 1989, now abandoned, which is a continuation-in-part of U.S. application Ser. No. 07/089,749, filed Aug. 27, 1987, now abandoned. U.S. application Ser. No. 08/434,755 is a continuation of U.S. application Ser. No. 08/208,787, filed Mar. 11, 1994, now abandoned, which is a continuation of U.S. application Ser. No. 07/828,44 filed Jan. 31, 1992, now abandoned.

BACKGROUND OF THE INVENTION

1. Field of the Invention

This invention relates to improved athletic shoes of the type having flexible uppers and, more particularly, to athletic shoes suitable for exercise activities, for example, for basketball, aerobics, tennis or for activities such as running. The invention is also directed to an underfoot support system which provides improved shock absorption (cushioning) and support.

RELATED ART

It is known that athletic footwear must perform as a stable and comfortable support point for the body while subject to various types of stress. It is important that the shoe be comfortable and provide adequate support during the various foot movements associated with athletic activity.

Articles of footwear typically include an upper and a sole, and are sold in a variety of sizes according to the length and width of the foot. However, even feet of similar length do not necessarily have the same geometry. Therefore, the upper may be adjustable to accommodate various foot contours. Such adjustment may include medial and lateral side portions which, when tensioned, provide support to the foot. In addition, the upper may include an ankle portion which encompasses a portion of the ankle region of the foot and thereby provides support thereto.

The common way to adjust the size of a shoe is through lacing. Lacing alone, however, suffers from several disadvantages, for example, when the shoe laces or strap is drawn too tightly, the fastening system can cause pressure on the instep of the foot. Such localized pressure is uncomfortable to the wearer and can make it difficult for the shoe to be worn for prolonged periods of time. Furthermore, while such fastening systems allow the upper of the shoe to be adjustable to accommodate varying foot and ankle configurations, they do not necessarily mold to the contour of individual feet. Moreover, regardless of how much tension is exerted on the medial and lateral side portion, there still remain areas of the foot which are not supported by the upper, due to the irregular contour of the foot. Avoiding displacements between the footwear and the foot results in less strain on the ankle and other parts of the foot.

In the ski industry, there have been several attempts to provide cushioning to ski boots by using an inflatable bladder which is disposed in various locations within the ski boot. An example is found in U.S. Pat. No. 4,662,087 to Beuch. However, the technical considerations for providing cushioning to athletic shoes such as those used for basketball, tennis, aerobics and running do not parallel the technical considerations in the ski boot industry. Athletic shoes for sports such as basketball, tennis, aerobics and running have soft, flexible uppers which are stitched (not hard molded plastic as in ski boots). Additionally, athletic shoes must be relatively lightweight, inexpensive, and self-contained.

Ski boots are typically constructed to be much heavier than athletic shoes. Thus, when including a system for cushioning, such as a bladder system, the weight of the system is not a technical consideration.

Similarly, ski boots are a much more expensive consumer item than athletic shoes. Therefore, the same incremental cost of an inflatable bladder system used in ski boots cannot realistically be added to athletic shoes. Any cushioning system added to athletic shoes must be inexpensive and simple to use.

In this regard, it is imperative that athletic shoes be self-contained so that accessories, such as a detachable hand-held pump, are not necessary to the operation of the cushioning system.

In short, there are numerous devices for inflating the interior of the ski boot. Generally, the devices used in the field of ski boots do not have the same requirements as in the field of athletic footwear. It is extremely important in the field of athletic footwear (e.g., basketball, running, tennis, etc.) that any inflation cushioning device be lightweight, inexpensive and must include a pump which is integral with the shoe. Ski boots are heavy. Therefore, adding the weight of an inflation or support device is of little consequence. In athletic footwear, every ounce of weight is of great importance in the performance and comfort of the shoe.

Furthermore, the past decade has brought to the forefront the importance of exercise. Commensurate with the public awareness has been a flurry of activity in the development of footwear. One of the problems faced by the footwear industry relates to the physiological variances between people. Thus the requirements of footwear varies from person to person. *The Running Shoe Book* by Cavanaugh states, in discussing a study undertaken by the U.S. Army to determine the shape of soldier's feet, that "[p]erhaps the most important finding from this massive survey is contained in the following stodgy 'Army-ese' conclusion: '(to make a single last to fit all men) may not prove possible since it is evident that consistent or orderly schemes of dimensional inter-relationships applicable to all, or even a majority of men, probably do not exist.'"

In the last several years, Reebok International Ltd., the assignee of the present invention, has been successful in alleviating the problems associated with variations in foot shape by providing inflatable technology in the uppers of its shoes. The inflatable technology enables an individual user to custom fit his or her shoe by inflating the upper to fill in those gaps ordinarily present between the upper and the foot of a wearer. The Reebok inflatable technology, sold under the trademark THE PUMP utilizes a pair of thin sheets of material. The sheets are radio frequency (rf) welded about their periphery to form a substantially air impervious pocket or bag. The sheets are also welded together interiorly to moderate the inflated thickness of the system at selective locations. For example, a series of weld lines or spots may be located in the tongue region of the shoe (where only a small gap is expected between the foot and the shoe). The frequency of weld lines or spots is less in area where larger gaps are expected, for example around the malleoli of the wearer's foot.

It has been known to utilize fluids (gas or liquid) in the sole of footwear. For example U.S. Pat. No. 4,610,099 to Signori (the Signori patent) shows a shoe having an inflatable bladder in the sole. The Signori patent provides for the bladder to be inflated using a hypodermic needle insertion. While the device shown by the Signori patent allows a user to customize his or her shoe, the off-board inflation mechanism makes it difficult to inflate the bladder on an as needed basis. Unfortunately, the solution is not to simply slap an on-board inflation mechanism to the shoe. To do so creates extraordinary construction problems. The Signori patent does not address how a custom underfoot system would be adapted for performance in the forefoot. Similar devices are disclosed by U.S. Pat. No. 3,120,712 to Menken and U.S. Pat. No. 1,069,001 to Guy.

Another illustration of the attempts to utilize a fluid in the sole of a shoe is found in U.S. Pat. No. 4,123,855 which utilizes a liquid, e.g. water in an insole. While the material forming the insole is impervious, such a system does not allow for customization. Other systems which use a large molecule gas to attempt to inhibit diffusion or migration out of a bag under the foot sacrifice customization and do not give the user the availability to vary the pressure of gas within the bag.

The art cited above illustrates the problems associated with utilizing fluid under the foot. Typically, the art has developed in two directions. The first path recognized that the use of a gas such as air in an inflatable system has the potential to diffuse through the bag containing the air. To solve this perceived problem, a large molecule is used which does not diffuse through its container as readily as air. Unfortunately, even if such systems provided adequate support for the wearer, the support could not be varied by the user. Others recognized that providing variable cushioning under the foot was advantageous. What has not been fully appreciated until the advent of the present invention is the need for variable support as well as cushioning.

One of the monumental difficulties in providing a variable support system for under the foot, relates to the difficulties in manufacturing. Specifically, the assignee of the present application has learned from its experiences with inflatable technology that an inflation mechanism should be on-board to maintain maximum convenience for the wearer. In other words, the inflation mechanism, e.g. a butyl rubber bulb, should be physically attached to the shoe. Preferably the inflation mechanism is attached to the upper (as in shoes sold by the assignee under the trademark THE PUMP). Unfortunately, the upper of a shoe and the sole of a shoe are made separately and perhaps even at separate locations. The upper and the sole must then be assembled to form a shoe. In a inflatable system which is partially located in the upper (the inflation mechanism), partially located under the foot (the inflatable system or bag), and which must have a high degree of integrity (no leaks), the problems of manufacturing are monumental.

Another problem ignored previously relates to flexure of the sole. While it is well known to provide grooves in either the outsole or the midsole of a shoe to enable flexure of the shoe, shoes having inflatable technology have not previously taken necessary steps to ensure proper bending of an inflatable bag located under the foot. Whether an on-board inflation mechanism or a remote inflation mechanism is utilized on an inflatable system for under the foot, it is critical that the system flex in the desired location and that the interior weld lines are positioned in the most anatomical useful locations.

One of the objects of the present invention is to provide a system whereby variable support under the foot is achieved with an on-board inflation mechanism. Another object of the invention is to make such a support system using the anatomical features of the foot as a guide. In the past, systems have had quilting patterns under the foot which bore little relation to the human foot. Thus both static and dynamic comfort were considered in developing the present invention.

It is also an object of this invention to provide footwear, which is securely fitted and fastened to the foot of the wearer, whereby a comfortable but secure grip is assured around the ankle and around the instep of the wearer.

It is a further object of this invention to provide a bladder in an athletic shoe which is lightweight, inexpensive, self-contained, and easy to use.

SUMMARY OF THE INVENTION

In accordance with the purposes of the present invention as embodied and described herein, the present invention is an athletic shoe having an inflatable bladder which fits the anatomical shape of a foot and avoids possible gaps or empty regions between the upper and the foot.

The present invention is an athletic shoe having an upper made of a flexible material. A bladder is disposed within the flexible upper and is in communication with a pump which is attached to the upper, and forms a cavity. The pump may be conveniently located on the top of the tongue of the athletic shoe or on the side of the athletic shoe.

In one aspect of the invention, the bladder has a lateral side portion, a medial side portion, and an instep portion. The bladder may also include a release valve which may be disposed in close proximity to the pump.

In one aspect of the invention, the pump and a portion of the release valve are formed from a single molded piece of material which is welded to the bladder.

One advantage provided by the invention is the compensation of the inequalities or bumps due to the interlacement of the laces in the buckling zone. Another advantage of the invention is that a shoe is provided which helps push the heel of a wearer back in the shoe, toward a heel counter.

In addition, the present invention is extremely lightweight and simple. The invention allows a lightweight pump to be made integral with an athletic shoe, eliminating the need for a separate accessory (i.e., the pump) to be sold with the shoe.

In one aspect of the invention, a rubber bulb pump is formed on the top of the tongue of the athletic shoe or on the side of the shoe for convenient access.

In another aspect, the present invention is an athletic shoe which includes an upper and sole. The sole defines a cavity and an inflation bag is disposed within the cavity. The inflation bag having a welded periphery and having at least one interior weld located within the periphery. An inflation mechanism is provided for delivering fluid to the inflation bag. A foam layer is disposed above the inflation bag and has at least one flexure aperture. The flexure aperture is positioned above the interior weld and is sized such that the flexure aperture fully overlies the interior weld.

In another aspect of the invention a plurality of interior weld lines are utilized.

In yet another aspect of the invention an inflation mechanism is substantially permanently affixed to the upper.

In yet another aspect of the invention an athletic shoe includes an upper and a sole. The sole is attached to the upper and includes a midsole. The midsole defines a posterior cavity disposed substantially under the heel of a wearer and a anterior cavity disposed anteriorly of said posterior cavity. The athletic shoe further includes an inflation system. The system includes a posterior chamber formed from a first sheet of material having a thickness of greater than about 15 mils and a second sheet of material having a thickness of greater than about 15 mils. The first and second sheets are welded together to form the posterior chamber. The posterior chamber is disposed within the posterior cavity. An anterior chamber is provided which is formed from a sheet of material having a thickness of greater than about 15 mils and a sheet of material having a thickness of greater than about 15 mils. The sheets are welded together to form said anterior chamber. The anterior chamber is disposed within said anterior cavity. An inflation mechanism is attached to the upper and enables selective inflation of one of the chambers via a conduit.

A slider valve is provided which includes a slider housing which defines a substantially cylindrical bore. The slider housing has a valve inlet, an posterior valve outlet and an anterior valve outlet. The valve inlet, the posterior outlet, and the anterior outlet each define passageways which are in fluid communication with the cylindrical bore. A slider piston is disposed within the cylindrical bore and is oriented to enable a user to move the slider piston from a first position and a second position. In the first position, there is a passageway from the valve inlet through the anterior outlet to enable inflation of the anterior chamber. In the second position there is a passageway from the valve inlet through the posterior outlet to enable inflation of the posterior outlet. The piston may also be oriented between the first and second positions, in the "neutral" position where there is no air exchange through the valve.

In still another aspect, the present invention is an athletic shoe comprising a sole unit, an upper attached to the sole unit, an inflatable bladder, and an inflation mechanism. The sole unit includes a midsole and an outsole. A pressure measuring means is provided to measure the pressure within the bladder. The pressure measuring means is permanently affixed in fluid communication within the bladder. The inflatable bladder may include two chambers. One of the chambers may be positioned beneath the user's foot within a cavity provided within the midsole. The shoe may include a valve to selectively block the fluid path to one of the two chambers. A foam layer may be positioned above at least one of the two chambers. The inflation mechanism may be integral with the upper. Alternatively, the inflation mechanism may be a canister of pressurized $CO_2$. A valve for releasing fluid from the bladder may also be provided.

BRIEF DESCRIPTION OF THE FIGURES

The accompanying drawings, which are incorporated in and form a part of the specification, illustrate the embodiments of the present invention and together with the description serve to explain the principles of the invention. In the drawings:

FIG. 1 is a left side view of footwear incorporating one embodiment of the invention;

DETAILED DESCRIPTION OF THE PREFERRED EMBODIMENTS

Figure 2:
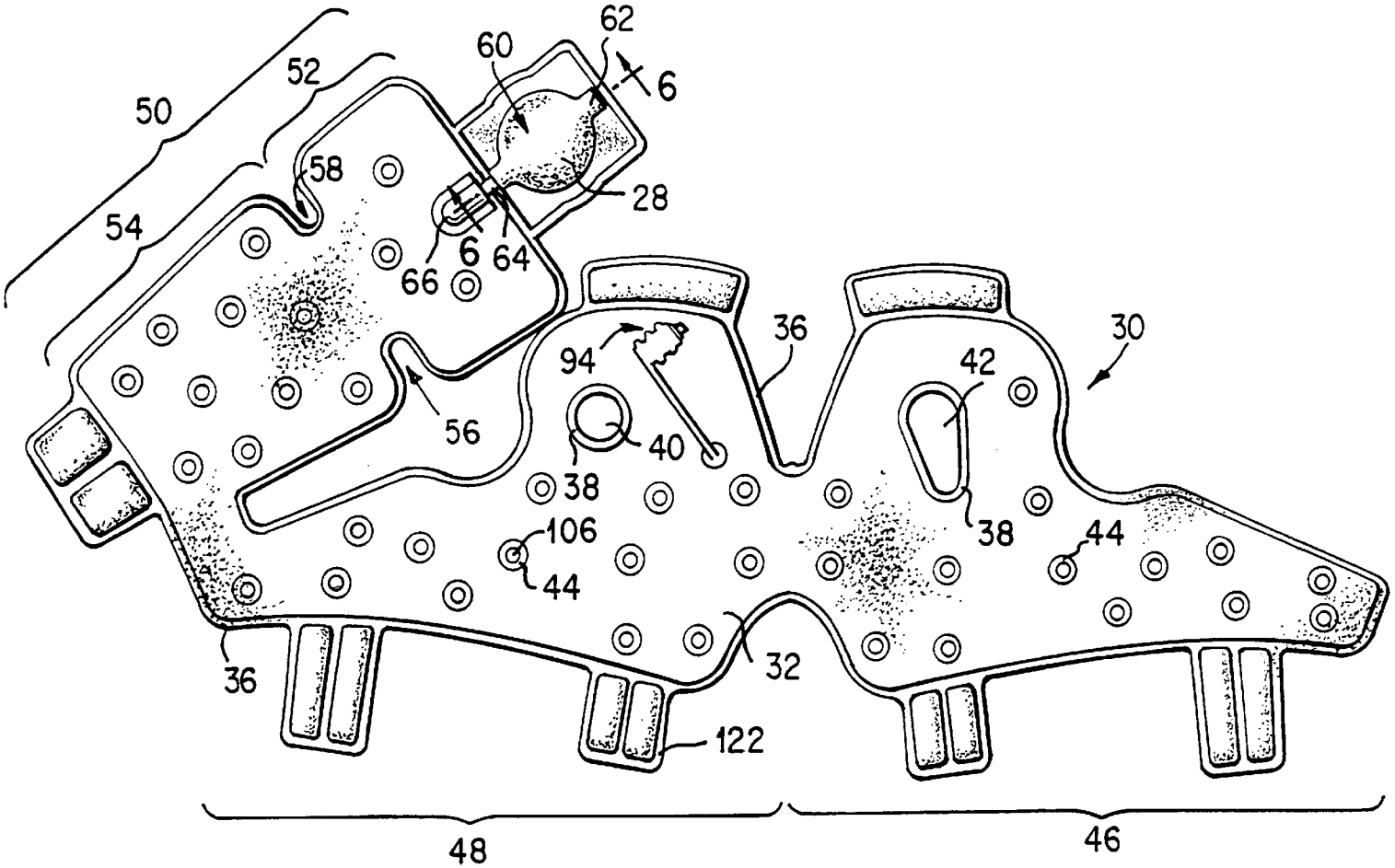
FIG. 2 is one embodiment of a bladder of the present invention.

Reference will be made in detail below to the preferred embodiments of the invention, examples of which are illustrated in the accompanying drawings in most instances. Similar or identical structure is identified using identical numbers.

Referring now to the embodiment of the invention shown in FIG. 1, a shoe is shown generally at 10. Shoe 10 incorporates the support system of the present invention. The support system, which will be discussed in detail below, allows a wearer to select the desired pressure applied to the foot of the wearer.

A variety of shoe structures are capable of incorporating the present invention. However, it is preferred that shoe 10 include a sole, shown generally at 12, and an upper, shown generally at 14. The sole 12 generally includes a ground engaging outsole 16 which is made of an abrasive resistant material as is conventional and generally found in athletic shoes (such as basketball shoes, tennis shoes, aerobic shoes, running shoes, etc.). Disposed between outsole 16 and upper 14 is a midsole 18 which is typically made out of ethyl vinyl acetate (EVA) or polyurethane (P.U.). Although foam EVA and P.U. midsoles are well-known, there are other possible midsole configurations and structures that could be used in conjunction with the present invention. For example, it is possible to use the present invention in conjunction with pneumatic midsoles or midsoles having support structures which are made of materials such as HYTREL, a material available from E. I. DuPont de Nemours and Co. An example of such a support structure is sold by Reebok under the trademark ENERGY RETURN SYSTEM (ERS). This technology utilizes a plurality of HYTREL tubes which are encapsulated within the midsole of an athletic shoe. These tubes extend substantially perpendicular to the longitudinal axis of the shoe and help the midsole material return quickly to its original shape.

Foam materials other than EVA or P.U. may also form the midsole used in the present invention. The upper may be made from a generally flexible material such as leather or other material as is generally known in the art of athletic footwear. Upper 14 may be attached to sole 12 by any known methods.

FIG. 1 shows a shoe for the left foot. A shoe incorporating the principles of the present invention for the right foot would be substantially a mirror image of FIG. 1. Shoe 10 may include a heel stabilizer 20, a tongue 22, laces 24 and eyestays 26. Naturally, many modifications can be made to the upper 14 without affecting the operation of the invention.

The present invention is a unique device for providing support to the foot of a wearer. The invention is used in athletic shoes such as those with midsoles and flexible uppers. In addition, the shoe provides for a custom fit. To provide the support, a lightweight system which includes a bladder and pump is incorporated into an athletic shoe which enables a user to inflate a bladder to a desired pressure with a conveniently placed pump. The bladder, when inflated, helps push the heel of a wearer toward the back of the shoe, into a heel counter. In addition, the bladder is specially configured to assure that air is only distributed to those areas of the foot needing cushioning; it is lightweight so as to not significantly affect the ability of an athlete to move, and it provides support to improve fit and reduce injuries.

Figure 3:
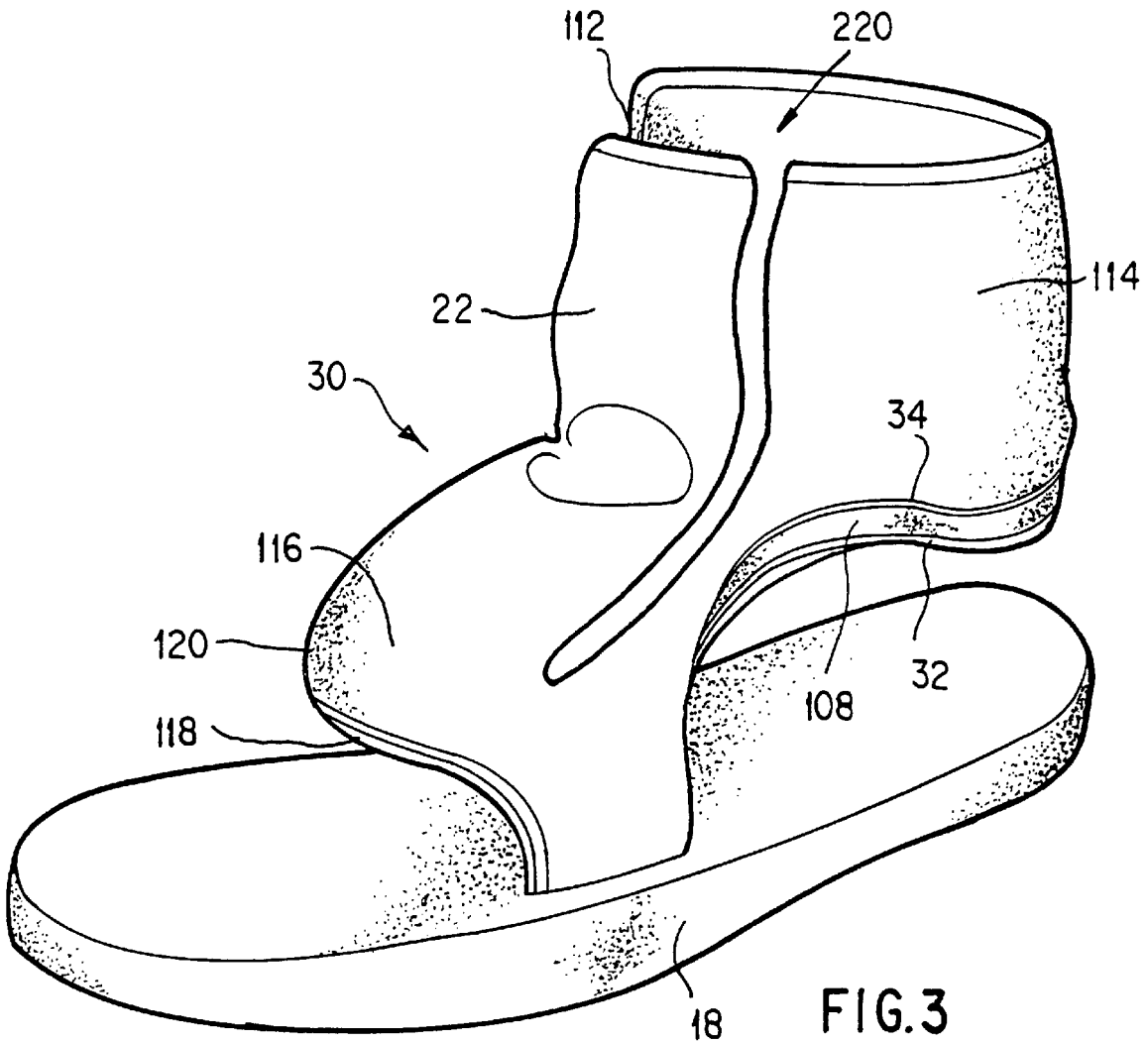
FIG. 3 is a perspective view of one embodiment of a bladder of the present invention.
Figure 4:
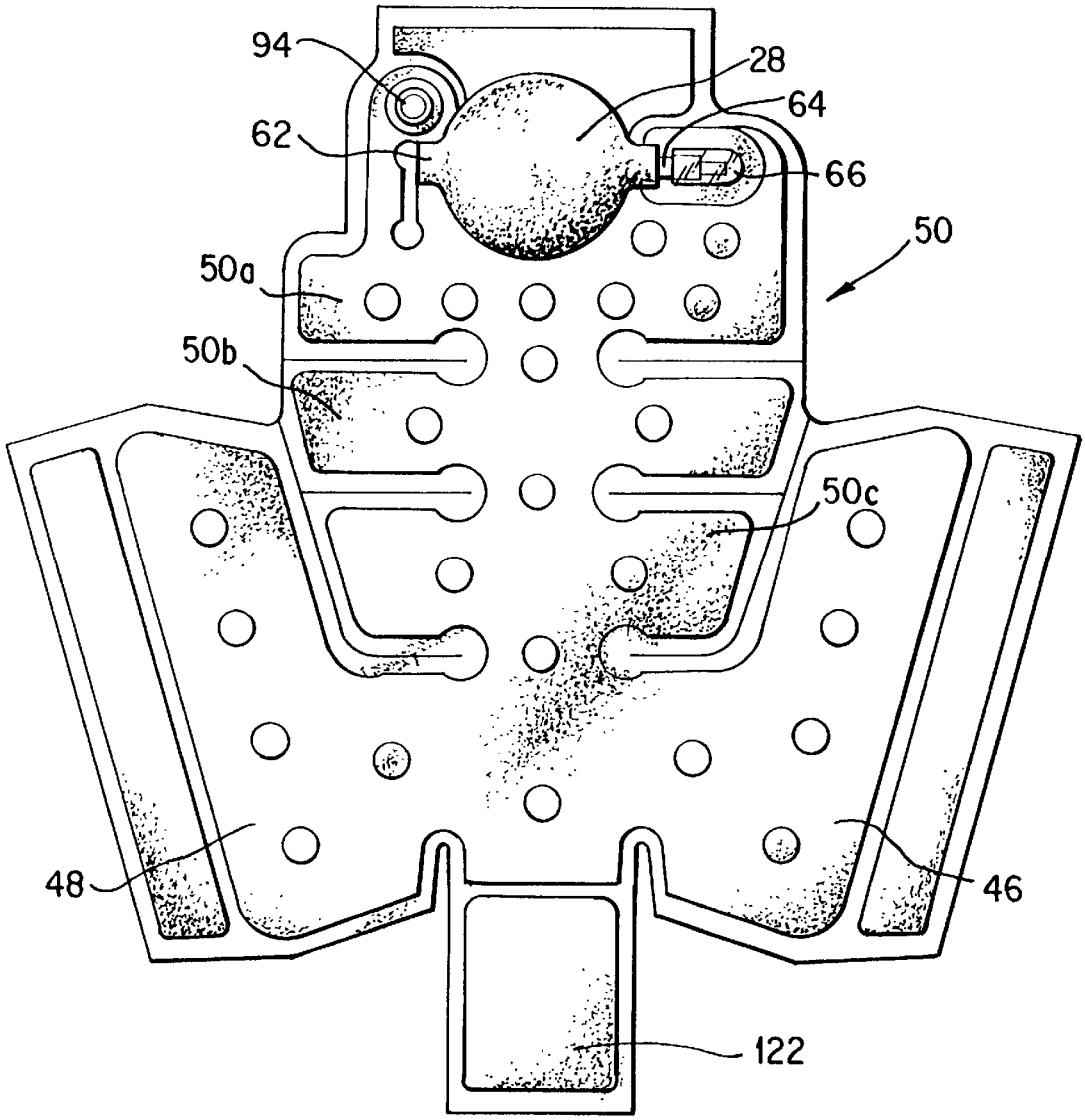
FIG. 4 is an alternative bladder of the present invention.

Referring now to FIGS. 2–4, three possible support systems of the present invention are shown. These systems include a pump 28 which is in fluid communication with inflatable bladder 30. Each component of the preferred elements of the support system as well as variations will be described individually below.

A. The Bladder

The bladder 30 is made of a number of component parts which include a first film or exterior layer 32 which is shaped as shown in FIG. 2. The exterior layer may be made of a lightweight urethane film such as is available from J. P. Stevens & Co., Inc., Northampton, Mass. as product designation MP1880. A second film or interior layer 34 (shown in FIG. 3) which is substantially co-extensive with exterior layer 32 is attached to the exterior layer 32 along periphery weld lines 36. The periphery weld lines 36 attach the exterior layer 32 to the interior layer 34 and prevent air from leaking therebetween. One example of a suitable method of attachment of the exterior layer 32 to the interior layer 34 is the application of high radio frequency (r.f.) to the edges of the first and second film. Interior weld lines 38 are also provided. These interior welded lines 38 are also formed by r.f. welding and define openings 40 and 42. In the embodiment of the invention shown in FIG. 2, a substantially circular opening 40 is used to accommodate the medial malleolus and an oblong opening 42 is used to accommodate the lateral malleolus. The shape of these openings is not critical to the practice of the invention. The interior layer 34 and the exterior layer 32 are attached at the periphery weld lines 36 as well as at the interior weld lines 38 and at the circular welds 44. The exterior layer 32 and interior layer 34 are otherwise not attached and enable a pocket or bladder to be formed which allows air or other gas to be introduced between the exterior layer 32 and the interior layer 34.

In addition, circular welds 44 are positioned throughout the bladder 30. These circular welds 44 are used to control the thickness of the bladder 30 when the bladder 30 is in its filled configuration (e.g., air has been pumped into the bladder 30). In regions of the bladder 30 where it is desirable to have the bladder inflated to a minimal thickness, the density of the circular welds 44 is greater than the areas where it is permissible or desirable for the bladder 30 to be inflated to a greater thickness. For example, it may be desirable to have the tongue inflate to a thickness which is less than the thickness around the ankles of the wearer. Conventional athletic shoes do not conform perfectly to the feet of the wearer. Such physiological variants as the size and shape of the ankle make it impossible to make a leather or canvas upper conform to the shape of the foot. It is, however, known where the largest spaces between the shoe and the foot are located. Thus, the circular weld density can be configured to have additional thickness in those areas.

Because the films forming the bladder walls are in contact at the circular welds 44, the thickness of the inflated bladder is reduced if there is a high density of circular welds 44. Conversely, if the circular welds 44 are far apart, that area between the circular welds 44 is allowed to expand to a greater thickness.

Figure 27:
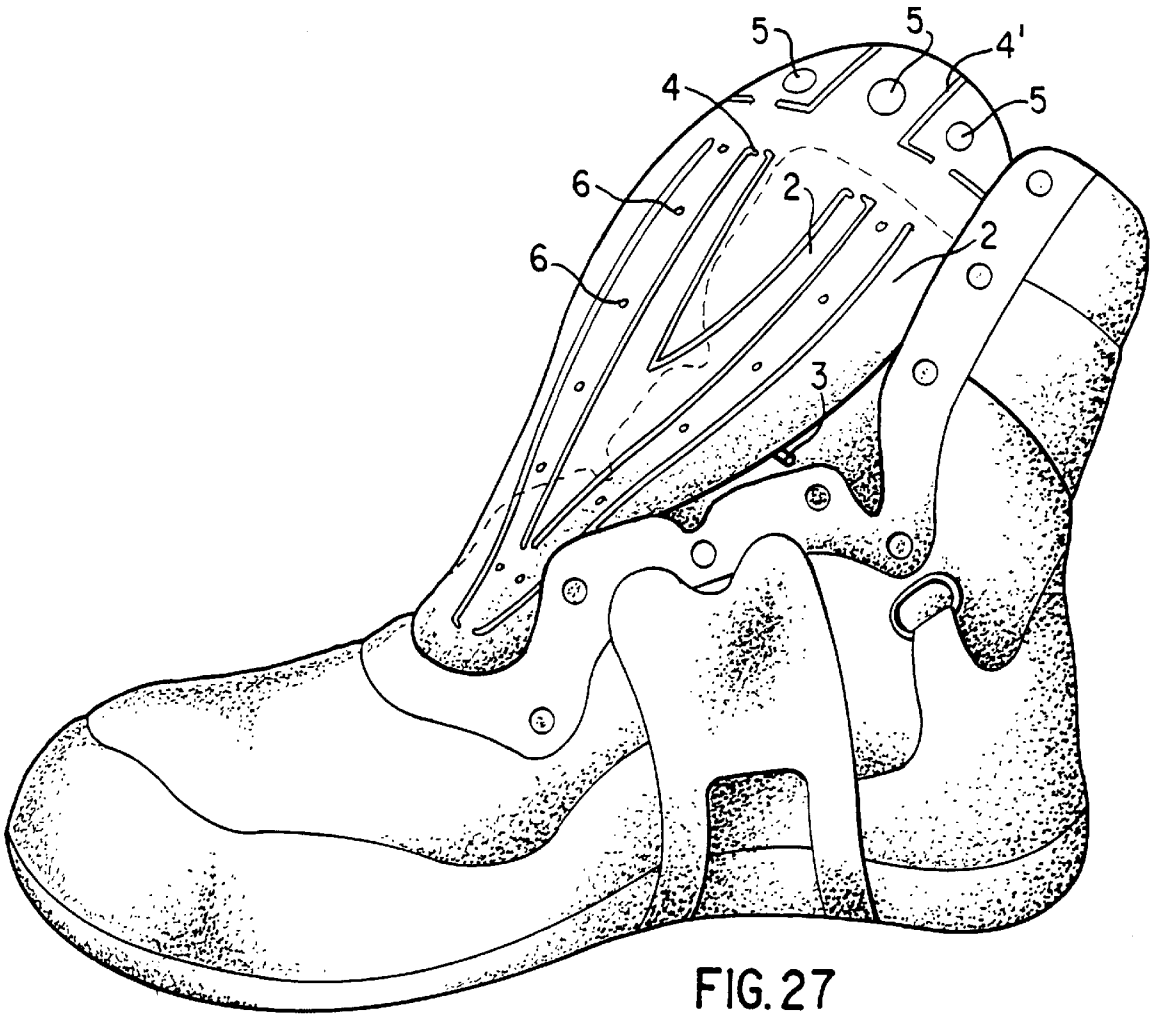
FIG. 27 is a perspective view of one embodiment of the present invention.
Figure 28:
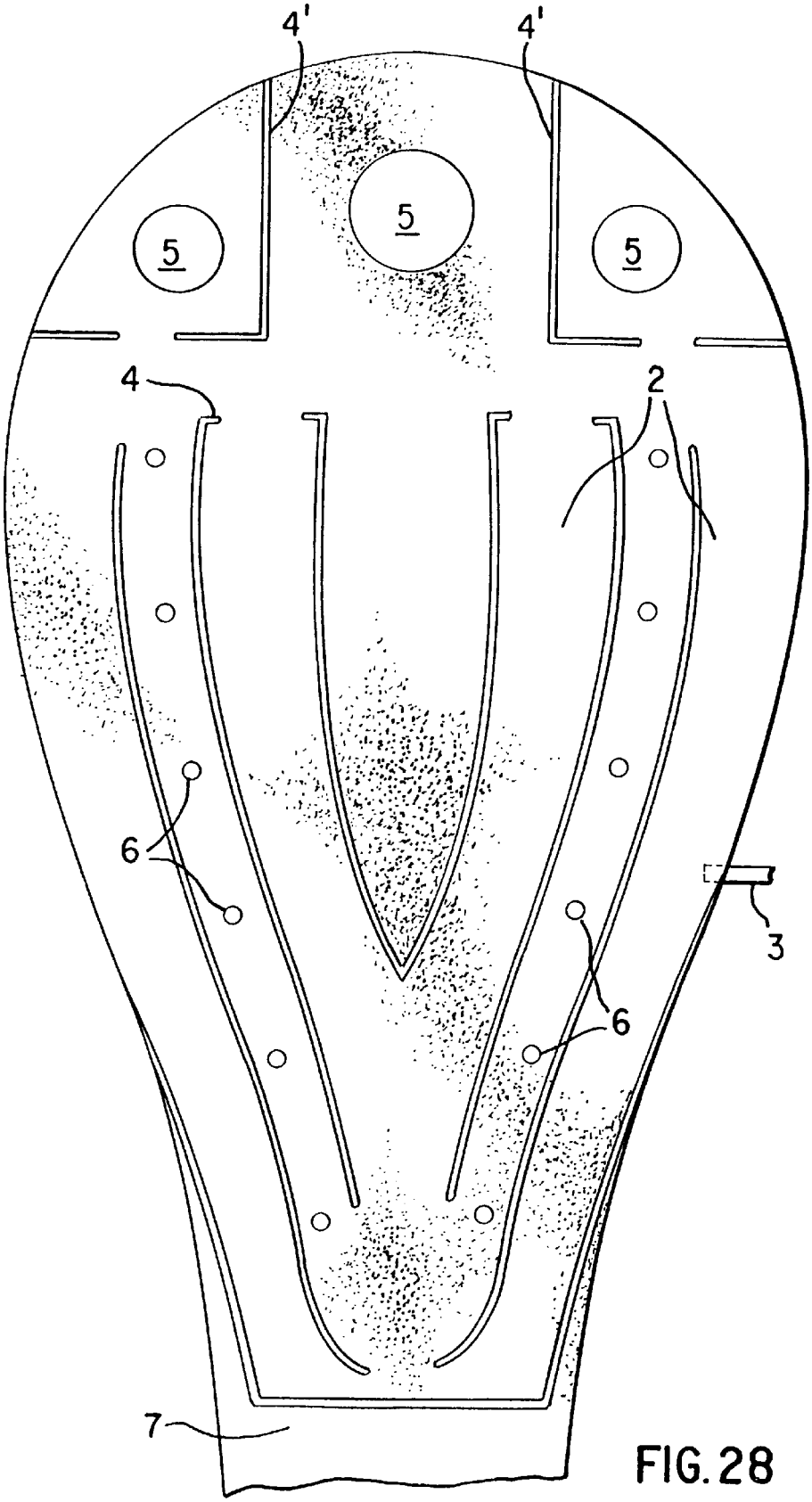
FIG. 28 is a top view of a tongue incorporating the present invention.

In addition to the use of circular welds to control the thickness of bladder 30 at particular locations, it is also possible to control the thickness of the bladder by the use of weld lines 4 and 4' (shown in FIGS. 27 and 28). In the embodiment of the invention shown in FIGS. 27 and 28, the bladder 30 is compartmented; individual compartments or fluid receiving chambers could be provided in various areas of bladder 30. One example would be to heat-seal seams along bladder 30. Such seams could also be perforated to allow ventilation to the foot. Such compartments may be interconnected or may be individually inflated by pump 28 or by several pumps.

The bladder shown in FIG. 2 has a number of different compartments which includes a lateral compartment 46, a medial compartment 48 and a tongue compartment 50. In the embodiment of the invention shown in FIG. 2, the density of circular welds 44 in the tongue region is high. Generally, it is not desirable for the tongue to obtain a thickness which is as great as the thickness in the lateral and medial compartments. By placing the circular welds 44 in selected locations, a contouring effect takes place whereby the regions having a low density of circular welds 44 will obtain thicknesses which are greater than the thicknesses of the high density regions.

In addition to the lateral compartment 46, the medial compartment 48, and the tongue compartment 50, each of these compartments may be further compartmentalized. For example, a first tongue section 52 and a second tongue section 54 may be placed in tongue compartment 50. The first section 52 and the second section 54 are separated by a pair of notches 56 and 58, one on each side of tongue compartment 50. These notches enable the tongue compartment 50 to easily flex at a location between the first section 52 and the second section 54.

The embodiment of the invention shown in FIG. 2 enables small aeration holes 106 to be placed in the circular welds 44. Because the welds 44 are circular and do not enable air to pass therethrough, the holes 106 can be placed within the welds 44 without risk of leakage of gas or air.

At one end of the tongue compartment 50 is a pump 28. The details of the pump shown in FIG. 2 and other pump configurations are discussed further below. In general, however, the pump shown in FIG. 2 is made of a hemispherical molded latex rubber located at the top of the tongue. Thus, when the bladder 30 is positioned in an athletic shoe, the pump 28 is conveniently located so that the wearer can simply place one finger, i.e., the thumb, on the rounded side of the molded rubber pump and another finger on the inside of the tongue, against the flat side of the pump. The pump can then be depressed to enable the bladder to be filled with air.

In the embodiment of the invention shown in FIG. 1, the pump is located in the back of the shoe. Alternatively, the pump can be placed on the tongue (as previously mentioned) or on either side of the shoe.

Figure 5:
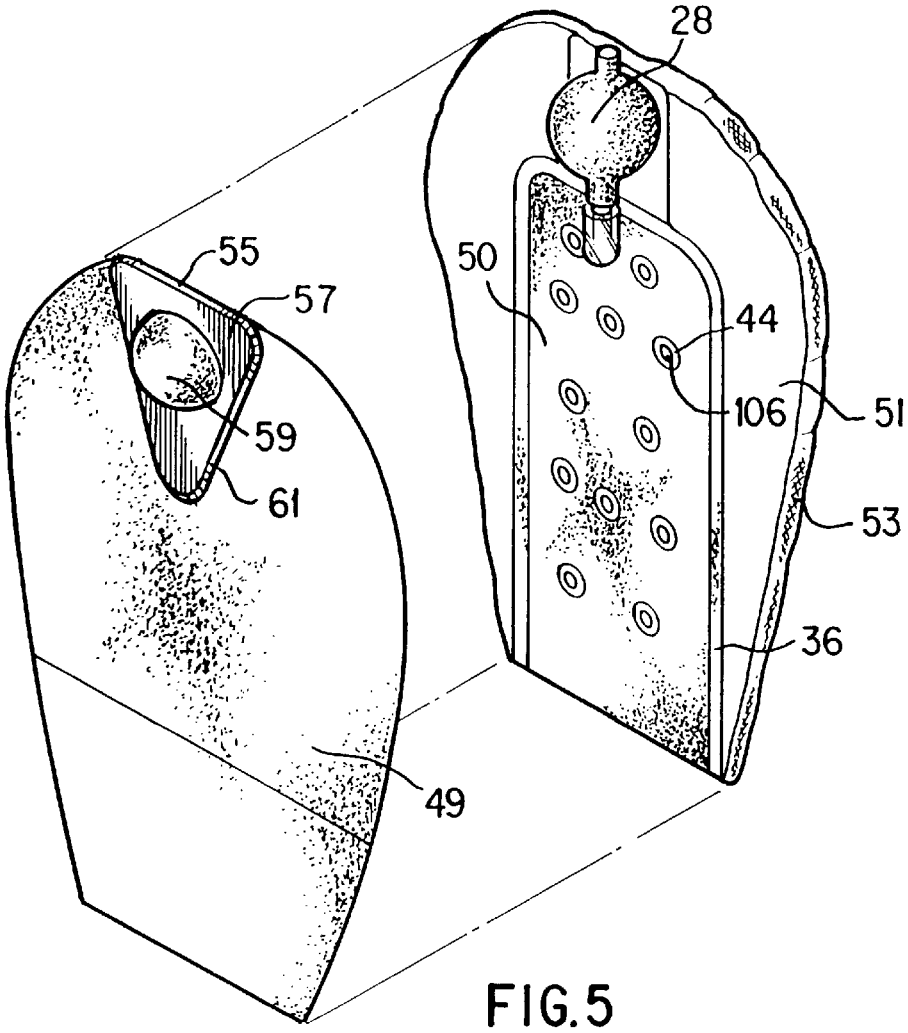
FIG. 5 is an exploded view of a tongue of one embodiment of the invention.

When the bladder shown in FIG. 2 is positioned within an upper of a shoe, the tongue compartment 50 lies between the outer material, e.g., leather or woven material, which would typically be seen in use and a layer of material such as flocking material. Referring to FIG. 5, an exploded view of a tongue used in the present invention is shown. The outer tongue material 49 is made of a conventional material such as leather or woven material or a combination thereof. The outer tongue material 49 is stitched to a tongue backing 51 which may include padding 53 and a cloth lining which makes contact with the foot of the wearer. The padding 53 may be made of any suitable padding material such as a soft foam which is conventionally utilized in the tongue of athletic footwear. Disposed between the outer tongue material 49 and the tongue backing 51 is one embodiment of a tongue compartment 50.

With continued reference to FIG. 5, a pump covering 55 is depicted. In a preferred embodiment of the invention, the pump covering 55 is made of a molded rubber material which has a substantially flat region 57, a bulb cover region 59, and a flange 61. The flange 61 enables the pump covering to be stitched to the outer tongue material. The bulb cover region 59 is generally hemispherically shaped and lies over the bulb shaped pump 28.

In operation of the bladder shown in FIG. 2, the tongue compartment 50 is placed within an upper of an athletic shoe between an outermost layer of material such as leather and an inner layer of material such as a lining within the shoe. Thus the bladder is not seen while in operation. The medial compartment 48 forms the medial portion of the shoe and again is disposed within the outer most layer or upper of the athletic shoe and an inner layer of material. The lateral compartment 46 then wraps around the heel and forms the lateral side of the athletic shoe. Again, this compartment is generally disposed between the flexible upper of the athletic shoe and an inner layer. The configuration of the bladder enables a single pump to inflate the entire upper of the athletic shoe. By providing the circular welds 44 in a particular orientation, for example that shown in FIG. 2, specific regions of the foot can receive more air than other regions.

A release valve 94 is disposed in the bladder 30 to enable air to be released. The details of the preferred release valve are discussed further below.

The bladder of the present invention may also have a number of other configurations. Referring to FIG. 4, a bladder 30 is shown for use in a low top athletic shoe such as a tennis, aerobics or running shoe. In this embodiment, the bladder has a tongue compartment 50. The tongue compartment 50 is segmented into three sections 50(*a*), 50(*b*) and 50(*c*). The tongue compartment is in fluid communication with a lateral compartment 46 and a medial compartment 48.

As with other embodiments of the invention, there are periphery weld lines 36 which connect two thin sheets of material such as lightweight polyurethane film. The sheets are welded together along weld lines 36 either by r.f. welding, heat welding, or by other suitable means, and then die cut to form the predetermined shape. The bladder 30 may include centering tabs 122 which are not filled with air but which are designed to help center or position the bladder 30 during the manufacturing process.

In operation of this embodiment (FIG. 4), the medial compartment 48 and the lateral compartment 46 are bent substantially perpendicular to the orientation they are shown in FIG. 4. As with other embodiments, a pump 28 is used to introduce air into the bladder 30. A release valve 92 may be used to release air from the bladder 30 according to the desires of the wearer.

The bladder of the present invention may also utilize a foam layer 108 (seen in FIG. 3) disposed between interior layer 34 and exterior layer 32. As previously stated, both exterior layer 32 and interior layer 34 are comprised of a suitable material, for example, a urethane film. Foam layer 108 may be comprised of any suitable resilient material capable of allowing fluid to pass therethrough. One example is an open-cell foam such as a polyurethane open-cell or reticulated foam having 10 to 55 PPI (pores per inch). Such material is available from United Foam Plastics of Georgetown, Mass.

Exterior layer 32 and interior layer 34 with foam layer 108 disposed therebetween are attached at their edges to form bladder 30. Such attachment may be by any know methods, for example, by high radio frequency which welds the layers together, as described above. Alternatively, bladder 30 may form a part of upper 14 such that exterior layer 34 forms the interior of upper 14. Exterior layer 34 may have a brushed or napped surface facing the foot for improved comfort and may form the interior of the upper. Alternatively, a foot compatible liner may be affixed to the foot contacting surface of exterior layer 34.

Bladder 30 may include a foot opening 220, through which the foot of a wearer is inserted. Bladder 30 also includes a medial side portion 112, a lateral side portion 114, an instep portion 116, which underlies the tongue 22 of shoe 10, and a forefoot portion 118. Forefoot portion 118 connects medial side portion 112 and lateral side portion 114 with instep portion 116. Forward end 120 of bladder 30 terminates at a point short of the toe receiving end of sole 12. Alternatively, forward end 120 could extend the full length of sole 12, thereby covering the toes of a wearer, or forward end 120 could also be positioned at any point between the toe and heel receiving ends of sole 12.

Furthermore, while bladder 30 is shown to terminate where it joins sole 12, bladder 30 could extend along the top surface of sole 12, thereby underlying the foot of a wearer. One example of such a configuration would be to extend bladder 30 under the instep region of the foot to provide support and cushioning to the plantar arch.

The air pressure within bladder 30 affords support to the foot of a wearer otherwise unavailable from upper 14 alone. Furthermore, bladder 30 provides increased cushioning to the foot by molding to the particular contour of the foot and thereby, accommodating for anatomical irregularities inherent in the human foot. Therefore, bladder 30 allows the wearer individualized interior sizing of shoe 10.

Additionally, bladder 30 prevents uncomfortable localized pressure from the fastening system of the shoe by providing a cushion between the foot and the fastening system. Bladder 30 provides uniform cushioning by which pressure from the fastening system is distributed across bladder 30.

As shown in FIGS. 27 and 28, an athletic shoe is shown which is provided with a double wall tongue 1, within which there are arranged bags 2 which can be inflated through a small side tube 3 which is in turn provided with a valve for inflating, through a suitable tool. As it is best seen in FIG. 2, inflatable bags 2 may be all mutually connected, whereby pressure is uniformly distributed according to the shape of weld lines 4. Inflatable bags 2 have a slightly curved outline which diverges from the tongue base to the tongue tip, i.e., following the shape of said tongue, while at the free end of tongue 1 weld lines 4' are arranged at right angles in such a way as to define three bags, mutually connected as well, wherein the two lateral side ones are in the shape of quadrants of a circle. In order to avoid that the latter end inflatable bags, after inflating, take an excessively cushion-like shape, due to the position and structure thereof, welding spots or areas 5 are provided in a central region of these end bags respectively.

At the intermediate area of tongue 1, in order to allow for a certain degree of aeration of the foot fitted inside the footwear, two rows of through perforations 6 are provided, whose outline follows the one of the longitudinal inflatable bags 2. The base of the tongue, which must be fastened to the shoe upper, extends into a flap 7 of the same gas-tight material comprising the walls of the inflatable bags 2.

B. The Pump

Figure 6:
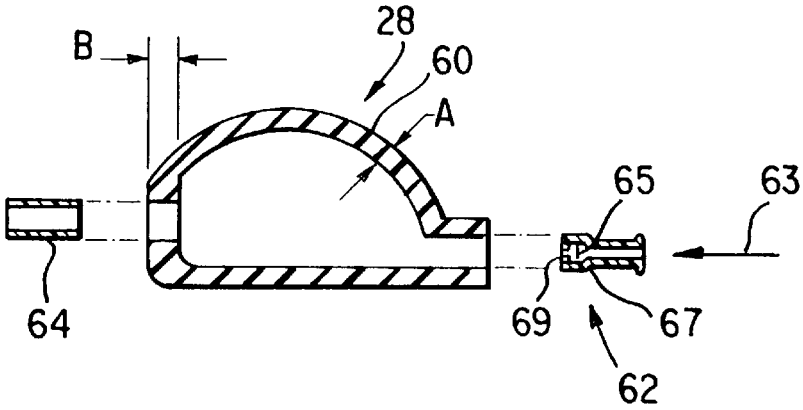
FIG. 6 is a cross section of the pump of FIG. 2 cut along line 6—6.

In the embodiment of the invention shown in FIGS. 2 and 4, the pump 28 has a body portion 60 which is made of a rubber material. The pump 28 may be molded from rubber such as butyl rubber or a latex rubber to form a rubber bulb. The pump 28 may also be a molded urethane or other material having good memory characteristics. If the pump 28 is a molded urethane, it can be welded to the bladder 30 with r.f. welding or the like. This embodiment of the invention simplifies construction of the pump and bladder assembly. The body is substantially hemispherical in shape with the flat portion of the hemisphere adhered to the exterior layer 32. At one end of the body portion 60 of pump 28 is a first pump valve 62 which prevents air from passing from the pump 28 to the atmosphere while allowing air to pass into the body portion 60. At the other end of body portion 60 is a connector 64 which enables fluid (typically air) to be communicated from the pump 28 to the interior of the bladder 30 which is formed between the exterior layer 32 and the interior layer 34. At the end of the connection between the pump 28 and the bladder 30 is a second one-way valve 66 which enables air to be forced into the bladder upon application of pressure to the pump 20. The one-way valve 66 prevents air from traveling from the bladder to the pump. Therefore, the bladder is pumped up simply by depressing the pump repeatedly until the bladder has reached a desired pressure. An exploded cross section of the pump of FIG. 2 is shown in FIG. 6. The pump 28 has a flat lower surface which is adhered to the bladder 30 and a hemispherical upper surface which enables air to be pumped into the bladder upon depression. The pump 28 may be made of injection molded rubber and may include an inlet check valve or first pump check valve 62 which is fitted into an opening in the pump 28.

FIG. 6 depicts the check valve 62 positioned outside the opening. In actual use, the check valve 62 is inserted into the hole and only enables air to travel in the direction of arrow 63. The operation of the check valve is as follows. A disc 65 for check valve is fitted between a shoulder 67 and retaining pins 69. The disc is free to move within the check valve 62 because it has a smaller diameter than the interior cylinder formed by check valve 62. If air is moving in the direction opposite the arrow 63, the disc abuts the shoulder and air cannot escape through the check valve. If, however, air is entering the check valve 62 in the direction of arrow 63, the disc 65 is retained against the retaining pins 69. The pins are intermittently spaced around the periphery of the cylindrical space forming the valve, thereby enabling air to pass around the disc 65 in those areas where the pins are not located. In short, the one-way check valve 62 enables air to move therethrough in the direction of arrow 63 only. During operation of the pump, the body of the pump 28 is squeezed, forcing air through a connector 64 and ultimately into the bladder. In actual use, the connector 64 would be inserted in a hole in one side of pump 28. The air which previously occupied the pump body portion is forced through the connector 64, through a one-way check valve (not shown in FIG. 6), and then into the bladder. That is, it will tend to return to its original shape after being squeezed. As the pump body returns to its original shape, air is forced through the check valve 62 in the direction of arrow 63. The pump is repeatedly squeezed to provide the desired pressure of air to the bladder. In a preferred embodiment of the invention, the wall thickness dimension A in FIG. 6 is approximately 2.0 mm and the wall thickness dimension B is approximately 3.0 mm.

In another embodiment of the invention (shown in FIG. 23), a small hole is formed on the top of the pump body 60. This hold obviates the need for one way check valve 62. By using a small hole in the top of the pump body 60, air is not permitted to escape to the atmosphere when the pump 28 is depressed because the thumb or finger of the user covers the hole. As the pump is released by the user, the small hole is uncovered, allowing air to enter the pump body 60. This embodiment facilitates easy and inexpensive manufacture of the pump and bladder system.

Figure 8:
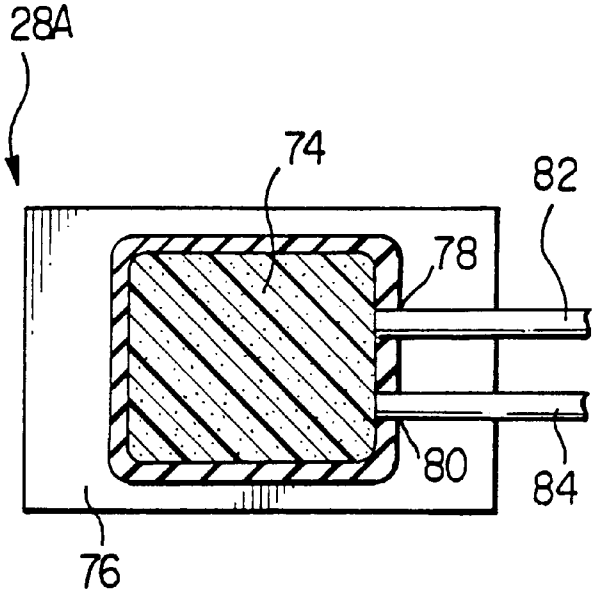
FIG. 8 is a top view of an embodiment of a pump of the present invention.
Figure 7:
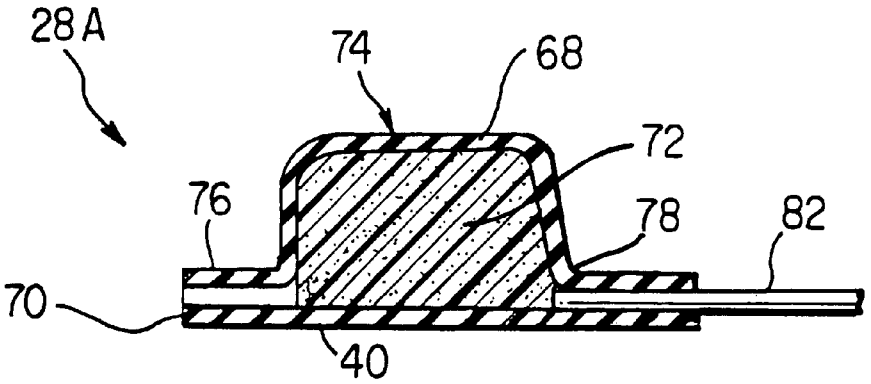
FIG. 7 is a cross section of one embodiment of the pump utilized in the invention.

With particular reference to FIGS. 7 and 8, another embodiment of a pump 28A for inflating bladder 30 is shown. Pump 28A includes a top layer 68 and a bottom layer 70, both of which are made from any suitable material, for example, a urethane film. One example of a urethane film which is applicable in the present invention is available from J. P. Stevens & Co., Inc., Northampton, Mass., as product designation MP1880. Disposed between top layer 68 and bottom layer 70 may be foam member 72. The function of foam member 72 is to add resiliency to pump 28A. Foam member 72 may be made of any suitable porous material which is capable of allowing fluid to pass therethrough. One example of a suitable material is a polyurethane open-cell foam having 10 to 55 PPI (pores per inch). Such as material is available from United Foam Plastics of Georgetown, Mass. Naturally, pumps other than the molded pump and the pump having a foam member in its interior could be substituted for those pumps specifically described in the present invention.

The bottom layer 70 of the pump 28 may be a substantially flat sheet of material which forms the side of the pump 28 which lies adjacent to upper 14 as seen in FIG. 1. Top layer 68 is a vacuum formed sheet which is shaped to define a cavity, and foam member 72 is commensurate in size to the cavity and is disposed therein.

The top layer 68 forms a first surface 74 which provides a surface convenient for forcing air from the cavity into bladder 30. The top layer 68 also has edge 76 which provides a surface for suitable attachment to the bottom layer 70. One example of a suitable method of attachment is by the application of high radio frequency (r.f.) to edge 76 and the bottom layer 70. application of the r.f. will cause the top and bottom layers 68 and 70, respectively, to adhere to one another. However, attachment methods other than r.f. welding are possible.

Referring specifically to FIGS. 7 and 8, one possible pump 30 is shown in which the cavity formed by top layer 68 and bottom layer 70 is approximately 1.0"×1.0"×0.5". The precise size and shape of the pump may be varied. Provided on pump 30 is an inlet port 78 and an outlet port 80. These ports may extend between the top layer 68 and the bottom layer 70 as shown or may extend through either the top layer 68 or bottom layer 70.

The pump 30 will generally be disposed on the upper 14 of athletic shoe 10. In FIG. 1, pump 30 is shown to be located in the back of the shoe with the bottom layer 70 being adjacent or next to the material forming the upper. The pump may also be located in other locations such as on the tongue of the shoe or on the vamp of the shoe. In the embodiment of the bladder depicted in FIG. 3, the pump is located in the tongue 22 of an athletic shoe. In this embodiment, the bladder can lie between the leather or other flexible material which forms upper 14 and a soft material which forms the interior of the shoe. If desired, the pump 30 can fit within a hemispherical cavity formed in the leather upper. This cavity can be formed from any of a number of conventional materials.

In the embodiment of the invention shown in FIGS. 7 and 8, the pump 30 is in fluid communication with the atmosphere via inlet tube 82. The outlet tube 84 is in fluid communication with the bladder 36. This can be seen in the schematic representation of the system which is depicted in FIG. 9.

The tubing which may be utilized with the present invention may be comprised of any suitable flexible, small diameter tubing material which is capable of being affixed to pump 28 and bladder 30. One example of tubing which is suitable for use with the present invention is a 1/16 inch I.D. ×1/8 inch O.D. clear polyurethane tubing which is available from Industrial Specialties, Inc., Englewood, Colo.

The inlet tube 82 has thereon an inlet check valve 86 which assures that air only flows into pump 28 from the atmosphere. One example of acceptable check valves for use with the present invention is model #2804-401, available from Air Logic, Racine, Wis. (other outlet valves will be discussed in detail below). The outlet tube 84 has an exit check valve 88 which ensures that, after bladder 30 is inflated to a desired pressure, air does not flow out of the bladder 30 through pump 28.

Figure 9:
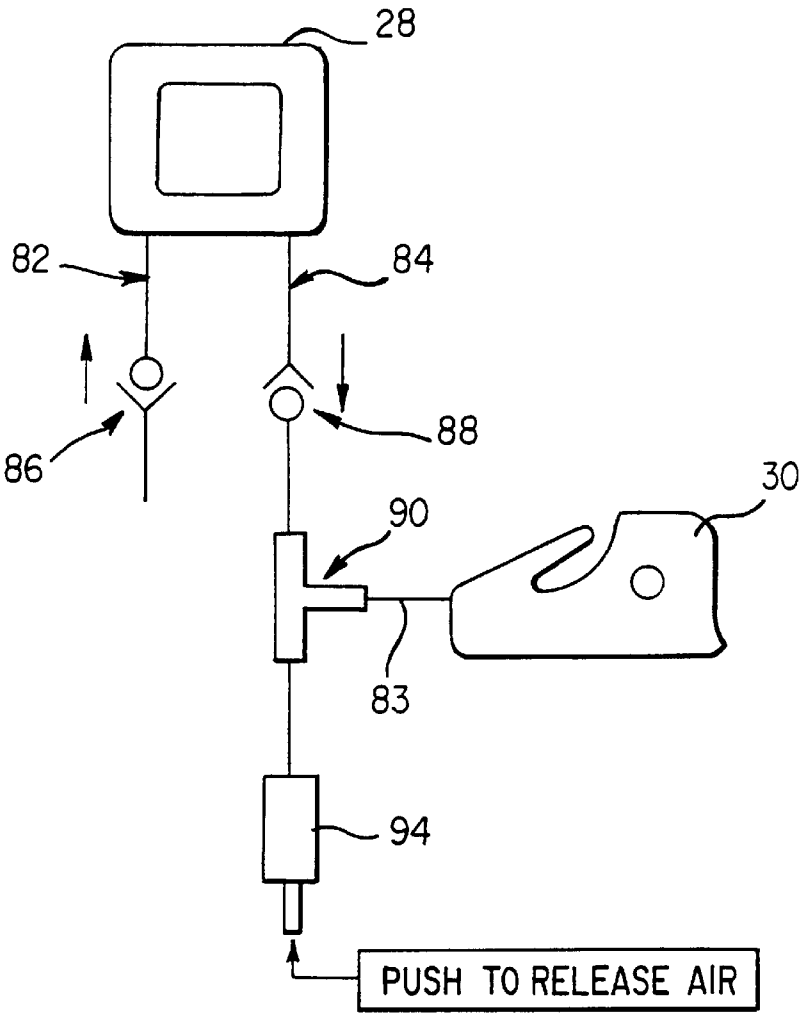
FIG. 9 is a schematic of one embodiment of the pump system used in the present invention.

As seen with continuing reference to FIG. 9, the outlet tube 84 is connected to a T-connector 90. Naturally, the exact shape of the T-connector 90 need not be a T-shape. The T-connector 90 enables air passing through outlet tube 84 to be in fluid communication with the bladder through a bladder inlet 83.

In operation, the pump 28 is depressed, thereby compressing foam member 72 if a pump having a foam member is used. The air which previously occupied the cavity in the pump 30 is prevented by a check valve 86 from escaping to the atmosphere. Therefore, the air is forced through outlet tube 84, through check valve 88 and into bladder 30. After the pump 30 is manually depressed, it is released. The foam and the other materials used to form the pump are made of materials with good memory and therefore the pump 30 quickly returns to its pre-depressed state. As it returns to its original shape, ambient air is sucked through inlet tube 82 (if used) via the one-way inlet check valve 86, into the cavity of pump 30. The pump is then depressed again and the process is repeated until the bladder 30 is inflated to a desired pressure.

To release pressure, release valve 94 may be depressed to allow air to escape from bladder 30. This release valve 94 may be positioned in a number of different locations as long as it is in fluid communication with the bladder 30. The details of a preferred release valve will be set forth below.

C. Release Valve

As previously mentioned, a release valve is used as part of the invention to vent air from the bladder. The release valve 94 is in fluid communication with the bladder 30 to enable venting or deflating of the bladder 30. While the release valve 94 may be located anywhere on the bladder 30, it is preferable that the release valve 94 be located on the bladder 30 where it can be conveniently activated by the user of the athletic shoe. For example, it may be preferable to place the release valve 30 close to the location of the pump 28.

Figure 10:
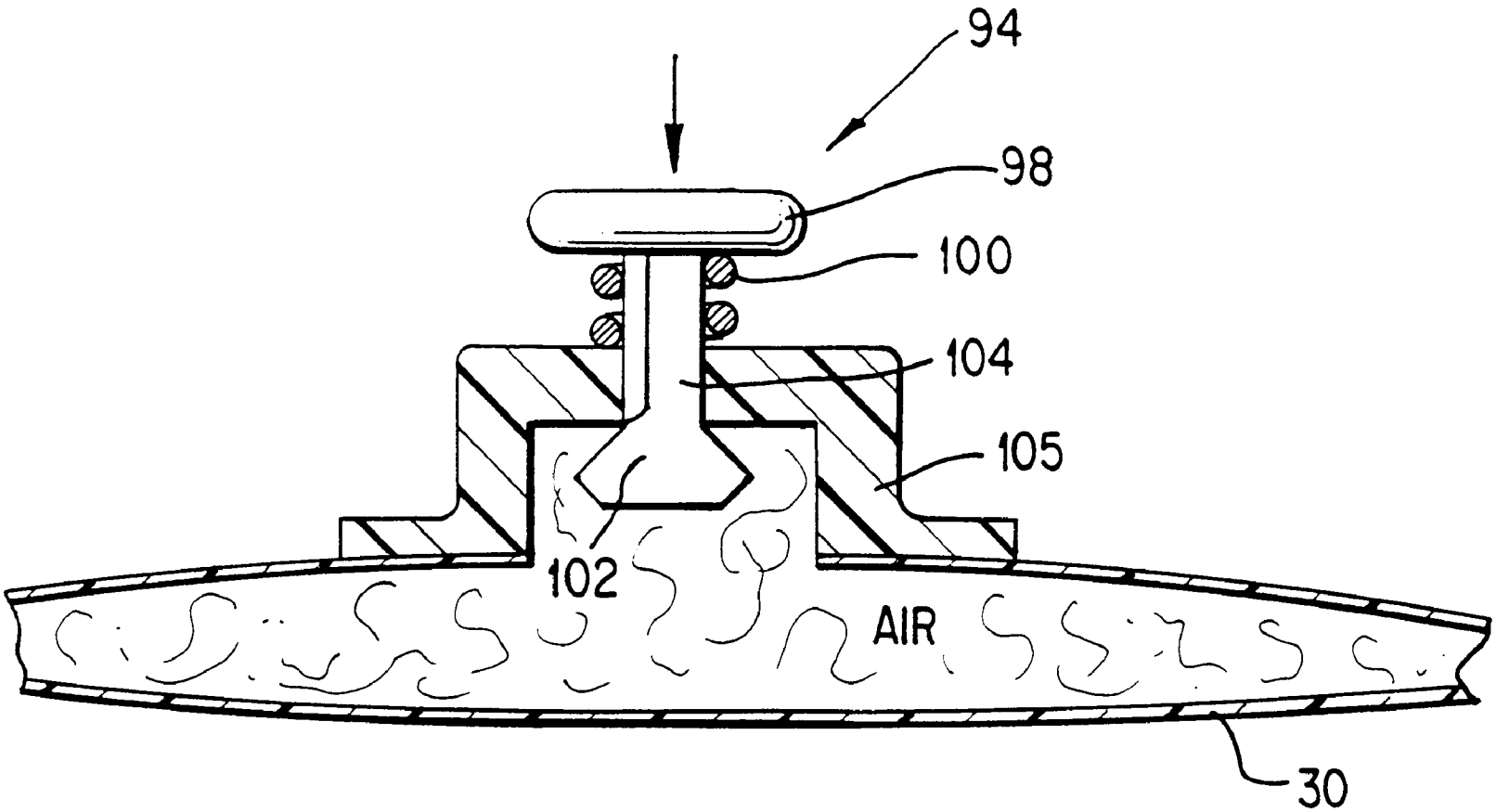
FIG. 10 is a cross sectional view of one valve used in the present invention.

While there may be a number of different types of release valves 30 which are suitable for practicing the invention, one preferred release valve is the simple device as shown in FIG. 10. The release valve 94 as shown in FIG. 10 can include a plunger 98 having a spring 100 which biases the plunger in the closed position as shown in FIG. 10. A flange 102 around the periphery of stem 104 of the plunger 98 keeps air from escaping between the plunger 98 and the release fitting 105 because the flange is biased in the closed position and in contact with the release fitting 105. To release air from the bladder 30, the plunger 98 is depressed by the user. Air then escapes around the stem 104 of plunger 98. This release valve is mechanically simple and light weight.

The components of the release valve may be made out of a number of different materials including plastic or metals. It may be preferable to use a material such as aluminum to form the plunger 98 because it is easier to ensure that an aluminum plunger will be of a particular geometry (e.g., round), thus avoiding leakage problems which can be created by a plunger of irregular shape.

In a preferred embodiment of the invention, the release fitting 105 is made of a molded urethane and, in fact, the release fitting 105 and the pump 28 may both be molded as a unitary single piece. Thus, a single molded urethane piece which comprises a pump 28 and a release fitting 105 can be welded to the urethane sheets which form a bladder 30.

Figure 23:
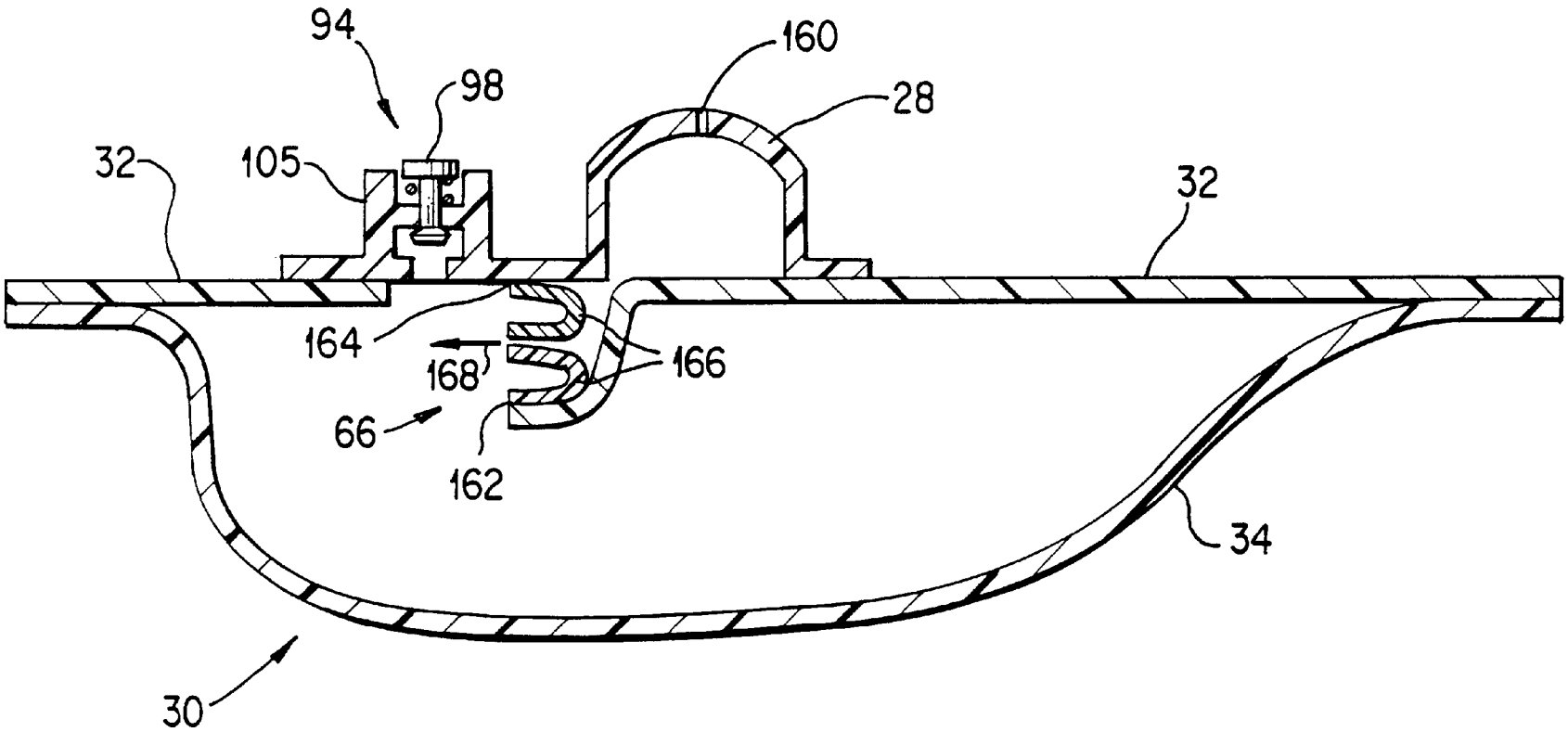
FIG. 23 is a cross sectional view of the bladder, pump and release valve of the present invention.

FIG. 23 is a schematic cross section of a pump, release valve and bladder assembly in which the pump and release fitting are molded as a unitary structure. This figure is intended for purposes of illustration and example and is not intended to be a to scale representation. FIG. 23 depicts an exterior layer 32 and an interior layer 34 which are welded together to form bladder 30. A pump 28 is provided which is made of molded urethane. A release valve 94 is also provided which, like the release valve depicted in FIG. 10, has a plunger 98 and a spring around the stem of the plunger. The release valve 94 has a release fitting 105 which is molded urethane. In a preferred embodiment of the invention, the pump 28 and the release fitting 105 are formed from a single piece of material. The pump 28 and release fitting 105 assembly is then welded to the bladder 30.

In the embodiment of the invention shown in FIG. 23, a small hole 160 is provided in the top of the molded pump 28 to allow air to pass into the pump and to act as a one way valve.

In operation, the pump 28 is depressed. The user typically will use a thumb to depress the pump 28; therefore, hole 160 is covered and air is free to pass into the bladder 30. After the pump is released by the thumb of the user, air passes through hole 160 to fill the pump interior volume.

Provided between the pump 23 and bladder 30 may be a second one way valve 66. This valve may be of the type described earlier with reference to FIG. 6 or may be as described below. The second one way valve 66 shown in FIG. 23 utilizes a pair of sheets of urethane material 166 which may be welded at weld points 162, 164. The sheets are folded in substantially a U-shape and allow air to pass therethrough only in the direction of arrow 168. Thus, a simple one way valve is constructed which is inexpensive and simple to manufacture.

To release the air from bladder 30, the plunger 98 of release valve 94 is depressed, enabling air to pass from the bladder 30 around the plunger 98 and into the atmosphere.

D. Dual Chamber Bladder Embodiment

Figure 11:
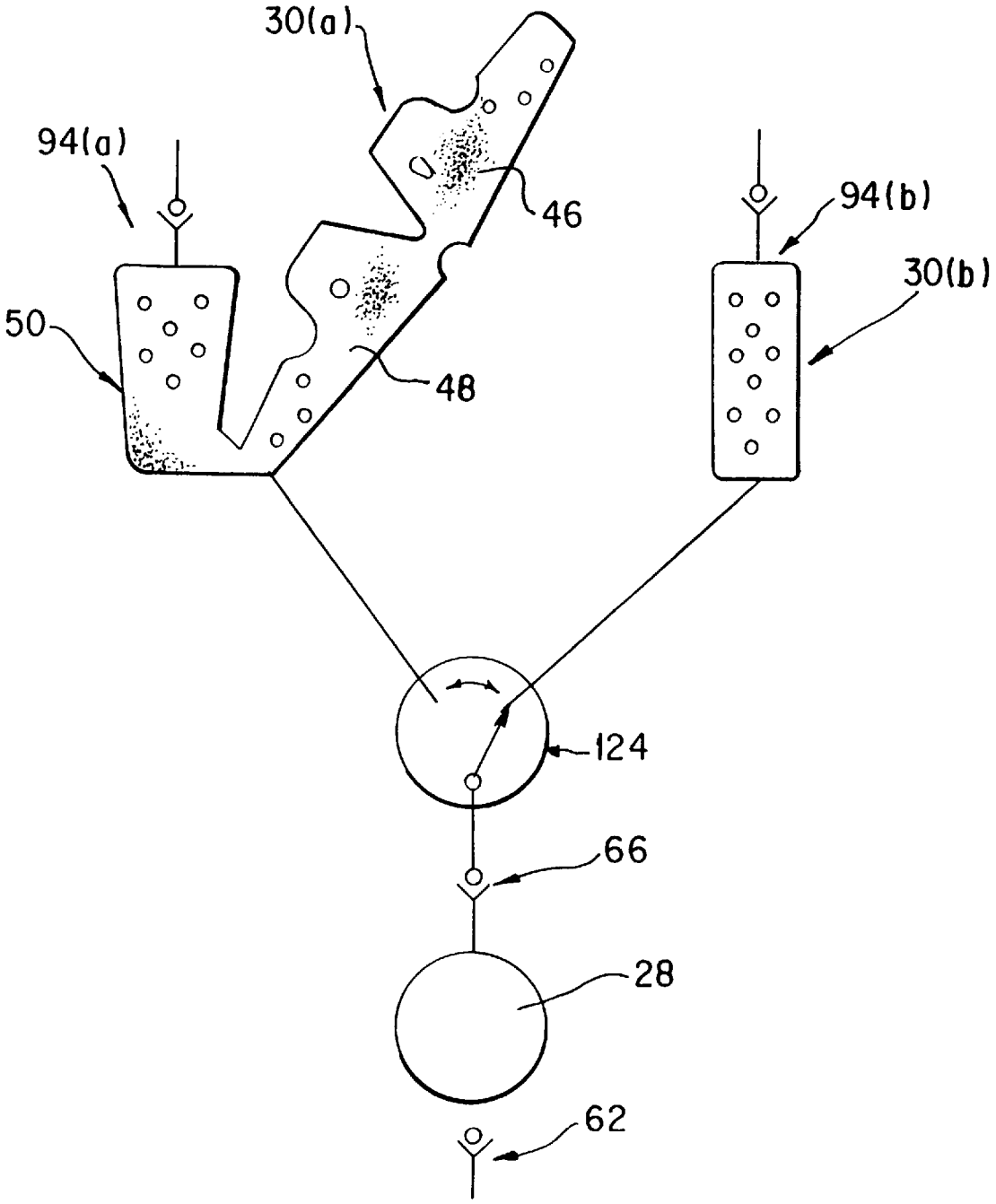
FIG. 11 is a schematic of a dual chamber bladder of the present invention.
Figure 12:
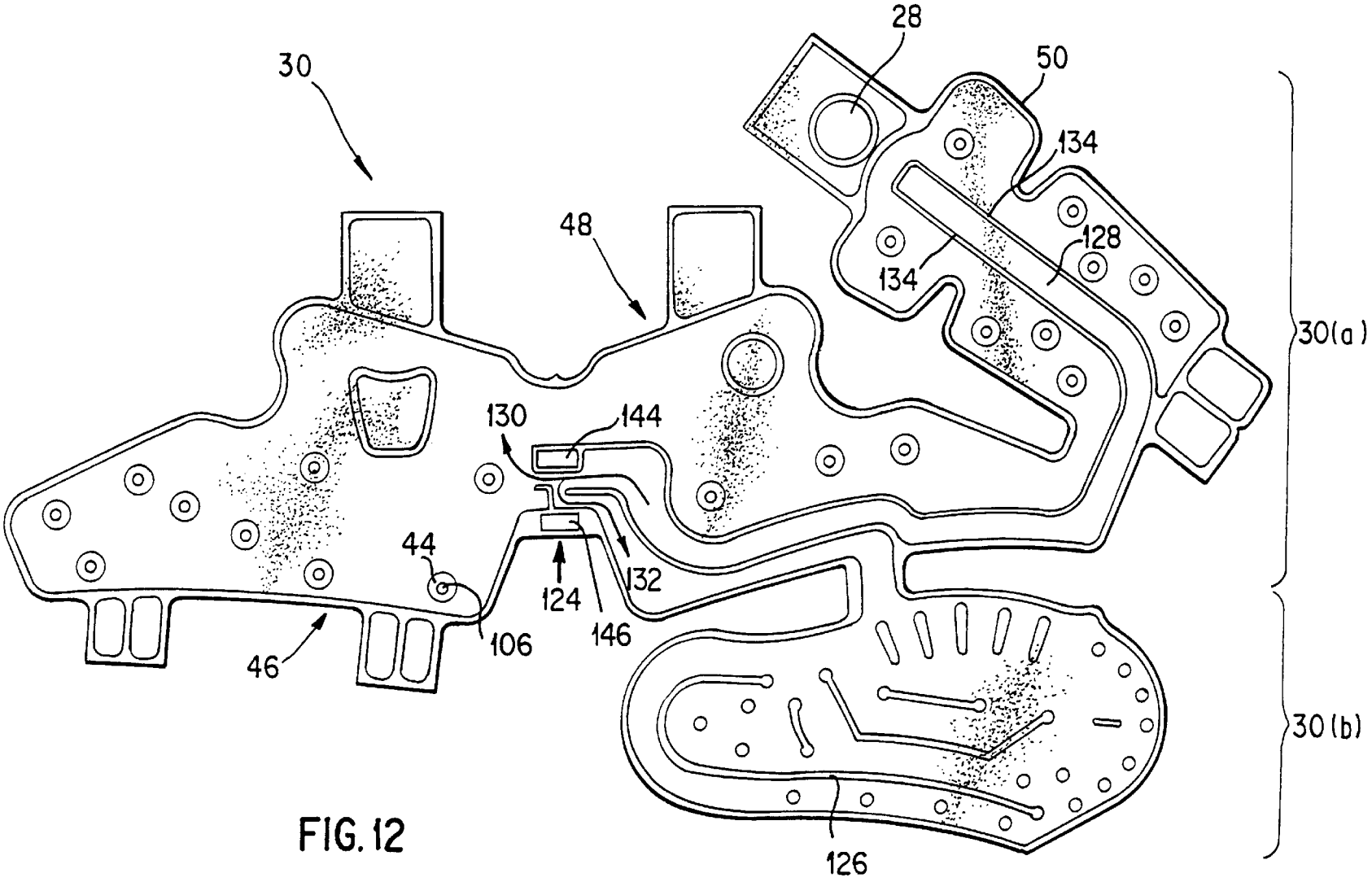
FIG. 12 is a dual chamber bladder of the present invention.
Figure 13:
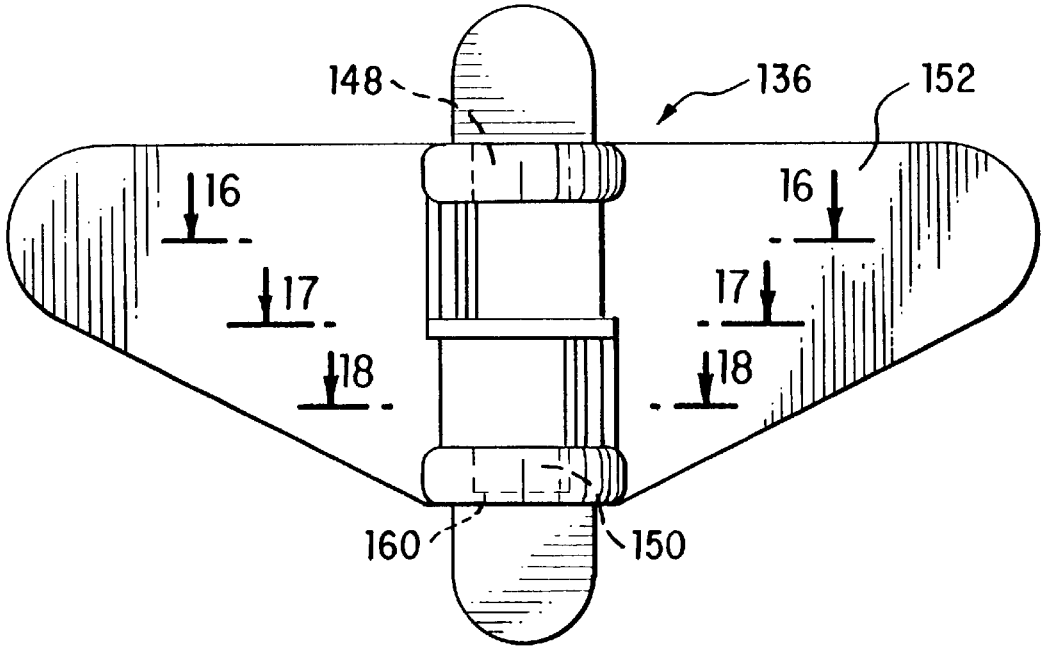
FIG. 13 is a backer plate of the present invention.
Figure 14:
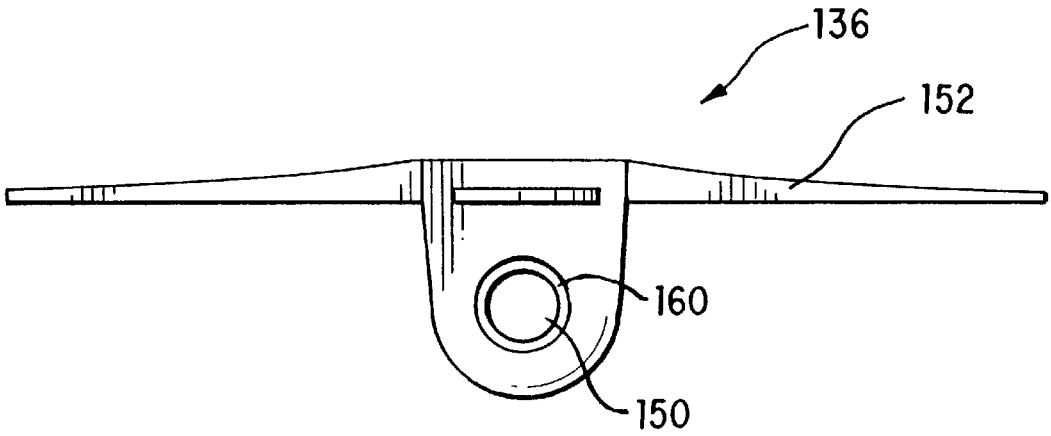
FIG. 14 is a top view of the backer plate of FIG. 13.
Figure 15:
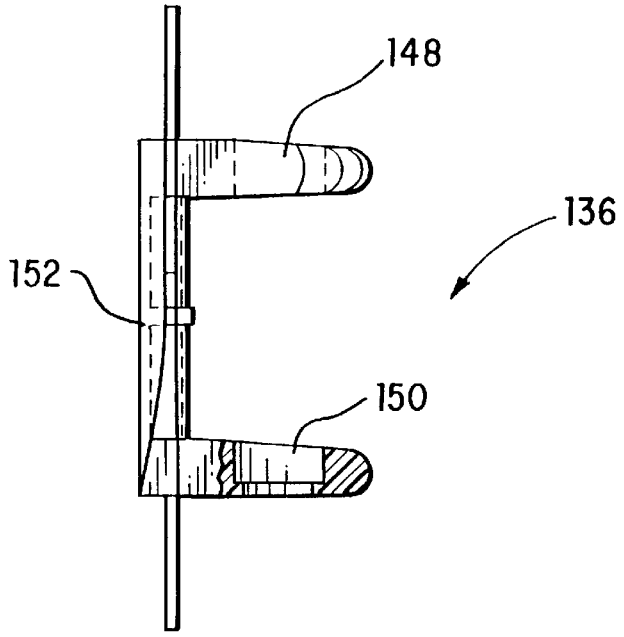
FIG. 15 is a side view of the backer place of FIG. 13.
Figure 16:
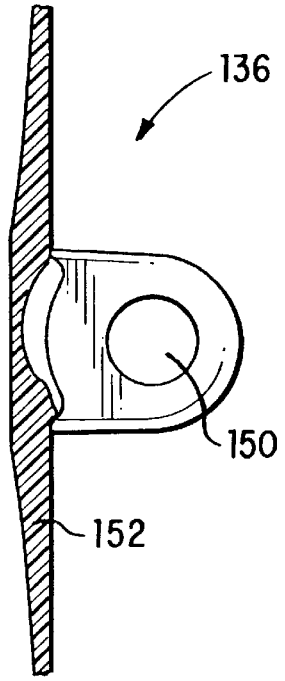
FIG. 16 is a cross section view of FIG. 13 cut along line 16—16.
Figure 17:
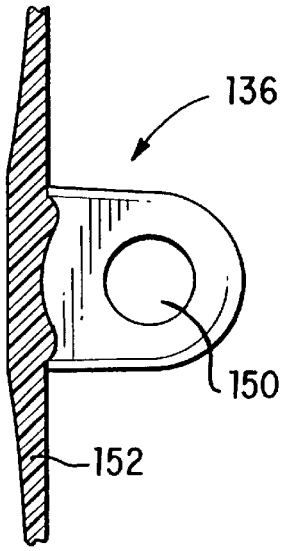
FIG. 17 is a cross section view of FIG. 13 cut along line 17—17.
Figure 18:
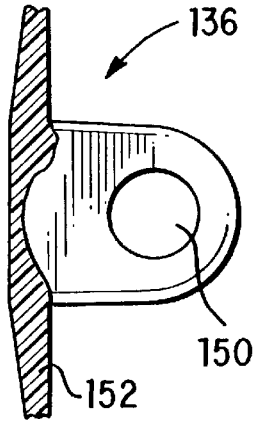
FIG. 18 is a cross section view of FIG. 13 cut along line 18—18.
Figure 19:
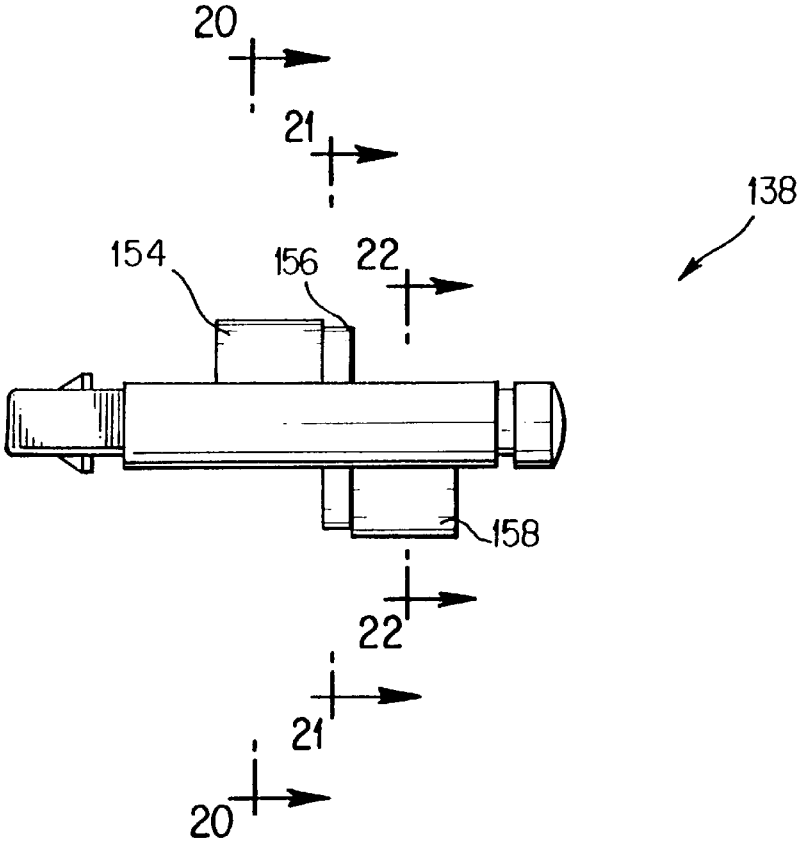
FIG. 19 is a cam device of the present invention.
Figure 20:
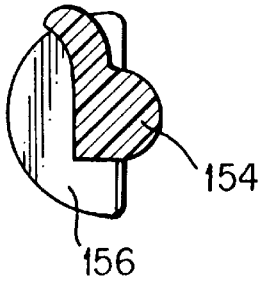
FIG. 20 is a cross section view of FIG. 19 cut along line 20—20.
Figure 21:
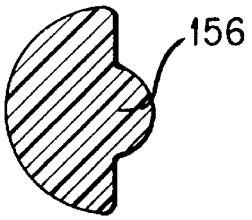
FIG. 21 is a cross section view of FIG. 19 cut along line 21—21.
Figure 22:
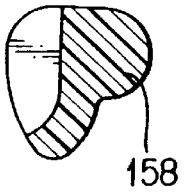
FIG. 22 is a cross section view of FIG. 19 cut along line 22—22.

In one embodiment of the invention, depicted in FIGS. 11 and 12, a dual chamber bladder system is used to selectively inflate predetermined regions of an athletic shoe. In this embodiment, a plurality of bladder chambers 30(*a*) and 30(*b*) are used in the invention. In the embodiment of the invention shown in FIG. 12, bladder chambers 30(*a*) and 30(*b*) are formed from the same material and are stamped out from the same sheets of urethane film. One of the bladder chambers may be positioned in the upper of the shoe as described with respect to the bladder depicted in FIG. 3. The bladder chamber 30(*a*) shown in FIG. 12 may take on a number of different shapes. However, like the bladder of FIG. 3, it may have a tongue compartment 50, a medial compartment 48 and a lateral compartment 46. As previously described, the bladder 30 may use circular welds formed by r.f. welding in selective areas of the bladder. The circular welds 44 may have aeration holes 106 therethrough as also previously described.

Similarly, a second bladder chamber 30(*b*) is provided which may be constructed in a manner similar to bladder chamber 30(*a*). That is, the bladder chamber 30(*b*) may be constructed using two thin sheets of urethane film which are welded together by r.f. welding or other suitable means and die-cut in a desired shape. The second bladder chamber 30(*b*) may be cut in a suitable shape to be inserted under the foot of a wearer to provide additional cushioning to the underside of the foot. Like bladder chamber 30(*a*), bladder chamber 30(*b*) may have suitable weld configurations which may include weld lines 126 as well as circular welds 44 as needed to accommodate the lower surface of a foot.

In a preferred embodiment of the invention, a single pump 28 is used to selectively inflate the two bladder chambers. Disposed downstream of pump 28 and upstream of the bladder chambers 30(*a*) and 30(*b*) is a manual switch 124 which enables a user to inflate either the bladder chamber 30(*a*) which is disposed in the upper or bladder chamber 30(*b*) disposed under the foot of the wearer. The switch 124 is not depicted in FIG. 12; however, the location of the switch used in the bladder of FIG. 12 is indicated by arrow 124. It may also be possible to utilize a three-way switch to selectively pump either bladder chamber 30(*a*), bladder chamber 30(*b*), or both bladder chambers 30(*a*) and 30(*b*)

simultaneously. Each bladder chamber 30(*a*), 30(*b*) is provided with a release valve 94(*a*) and 94(*b*) which enables excess air to be released from the bladder chambers 30(*a*), 30(*b*). One-way valve 62 as described with reference to FIG. 6 may be provided to allow air to fill the pump 28 after it has been depressed.

A second one-way valve 66 is also provided which keeps air which is forced out of pump 28 from returning to the pump 28 after the pump 28 is depressed.

Turning specifically to FIG. 12, a preferred embodiment of the dual chamber bladder is depicted. In operation, the pump 28 is manually operated to introduce air into channel 128 via a suitable conduit (not shown). The conduit and the pump 28 can be molded from a single piece of material. Channel 128 is in fluid communication with both bladder chamber 30(*a*) and bladder chamber 30(*b*) as shown by flow streams 130 and 132, respectively. Channel 128 is bounded by channel weld lines 134 which prevent air from entering bladder chamber 30(*a*) except as indicated by flow stream 130.

As can be seen in FIG. 12, the location of the valve for switching between bladder chamber 30(*a*) and bladder chamber 30(*b*) is the back of the heel of a wearer. This location is chosen for convenience of the user; however, it is understood that there are other suitable locations.

As previously stated, either bladder chamber 30(*a*) or 30(*b*) is selectively inflated by use of a valve which enables air to be directed to one or the other of the bladder chambers 30(*a*) or 30(*b*).

In a preferred embodiment of the invention, a switch is used which pinches off either flow stream 130 or flow stream 132 according to the preference of the user.

Although a number of different switches can be used to select which bladder chamber is to be inflated, one preferred pinching switch is shown in FIGS. 13–22. The pincher switch is constructed with two main components, a backer plate 136 (seen in FIGS. 13–18) and a cam device 138 (seen in FIGS. 19–22).

The bladder 30, seen in FIG. 12, is sandwiched between the backer plate 136 made of material such as transparent polyurethane and cam device 138 made of a hard plastic material such as acro butyl styrene (ABS) to selectively pinch off either flow stream 130 or flow stream 132.

The backer plate 136 includes projections 140 and 142 which project through openings 144 and 146 (seen in FIG. 12). The projections 140 and 142 form circular openings 148 and 150 for receiving cam device 138. The bladder 30 is thus oriented between cam device 138 and surface 152 on backer plate 136. The cam device 138 has a plurality of cam surfaces 154, 156 and 158 which cooperate with surface 152 of backer plate 136 to pinch off either flow stream 130 or flow stream 132. The cam device 138 is rotatably positioned in the circular openings 148 and 150. As the cam device 138 is rotated from a first position to a second position, the cam surfaces serve to pinch off either flow stream 130 or flow stream 132. A lip 160 is provided on the backer plate 136 (see FIG. 14) to prevent the cam device 138 from sliding completely through the circular openings 148, 150.

Figure 25:
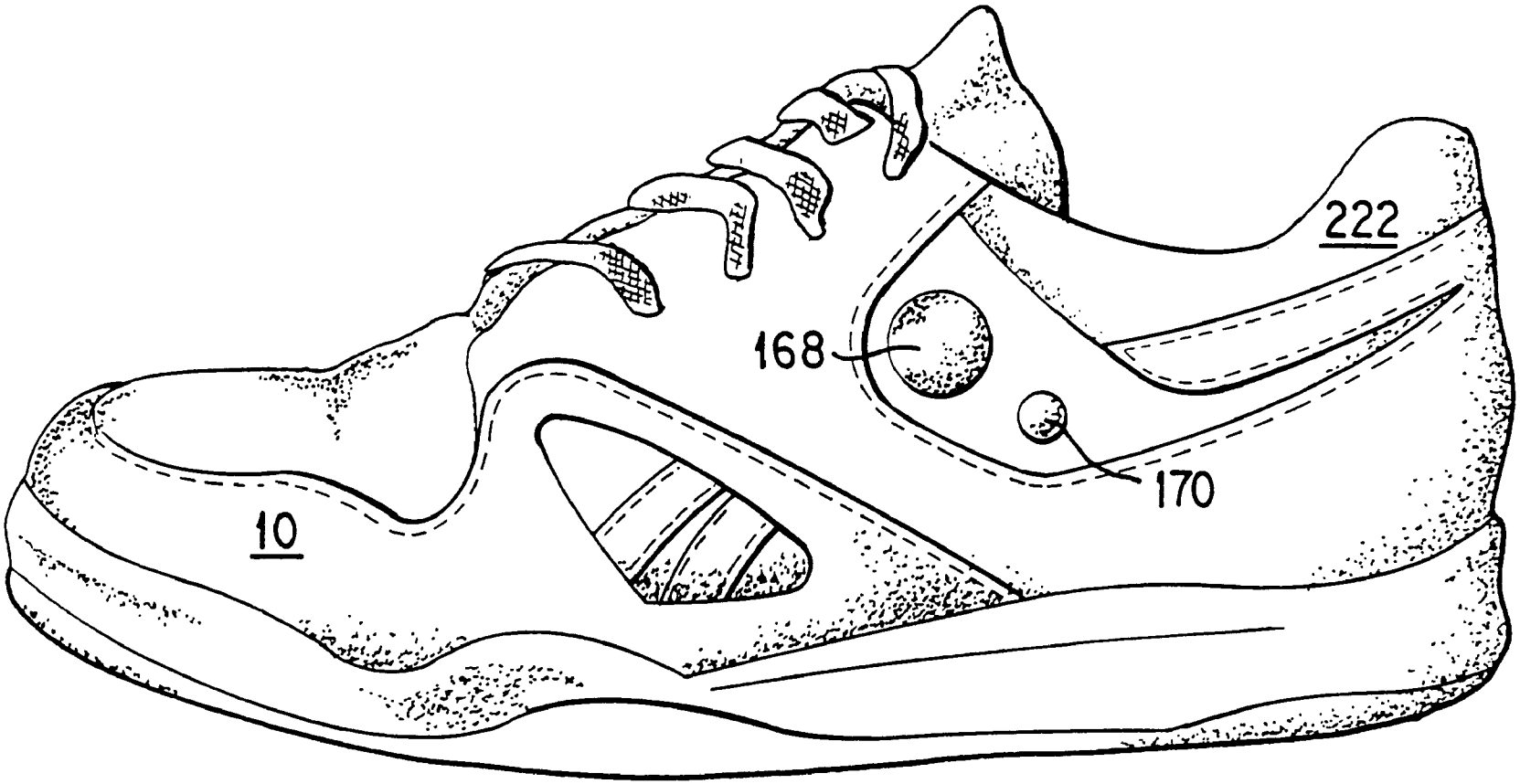
FIG. 25 is a lateral side view of a shoe incorporating the present invention.

Although the dual chamber bladder system described above locates the bladder chambers 30(*a*), 30(*b*) on the upper and under the wearer's foot, respectively, it is possible to have dual bladder chambers in other configurations. For example, a first bladder chamber could be located around the collar of a shoe (such as a basketball or tennis shoe) while a second bladder chamber could be located at the instep (the collar of the shoe depicted in FIG. 25 is designated with reference numeral 222). Similarly, more than two bladder chambers, with a selective inflation valve, could be utilized in practicing the invention.

E. Alternative Bladder Configurations

Figure 24:
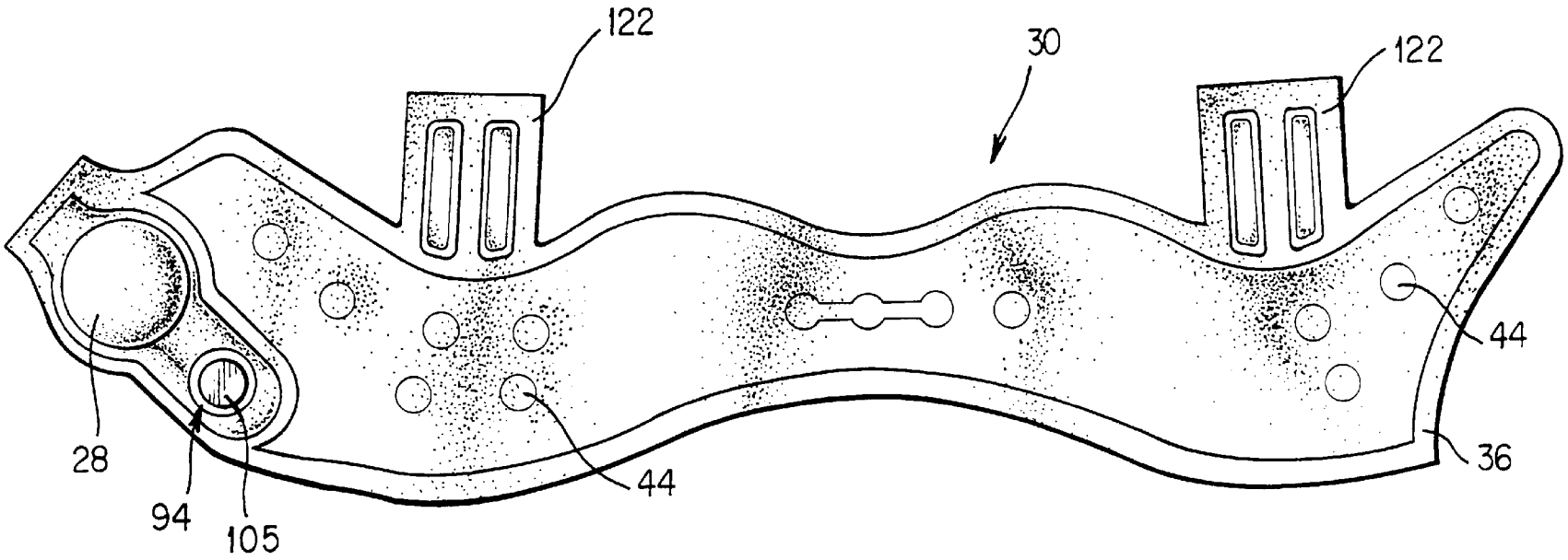
FIG. 24 is a collar bladder of the present invention.

Several other bladder configurations other than those described above may be used to practice the invention. For example, a bladder may be used which is specifically oriented in the collar of an athletic shoe. FIG. 24 shows a collar bladder of the present invention. Bladder 30, like previous embodiments, utilizes two sheets of urethane film welded together at periphery weld lines 36 and at circular welds 44. A pump 28 is provided which is made of molded urethane. The pump 28 and release fitting 105 of release valve 94 are monolithic. A plunger 94 fits within release fitting 105. When placed in an athletic shoe, bladder 30 wraps around the back of the foot of the wearer such that centering tabs 122 are substantially in line on opposite sides of the wearer's foot.

FIG. 25 shows generally the location of the pump and release valve on an athletic shoe 10. The pump 30 (of FIG. 24) is covered by pump covering 168 and the release valve (of FIG. 24) is covered by release valve covering 170.

Figure 26:
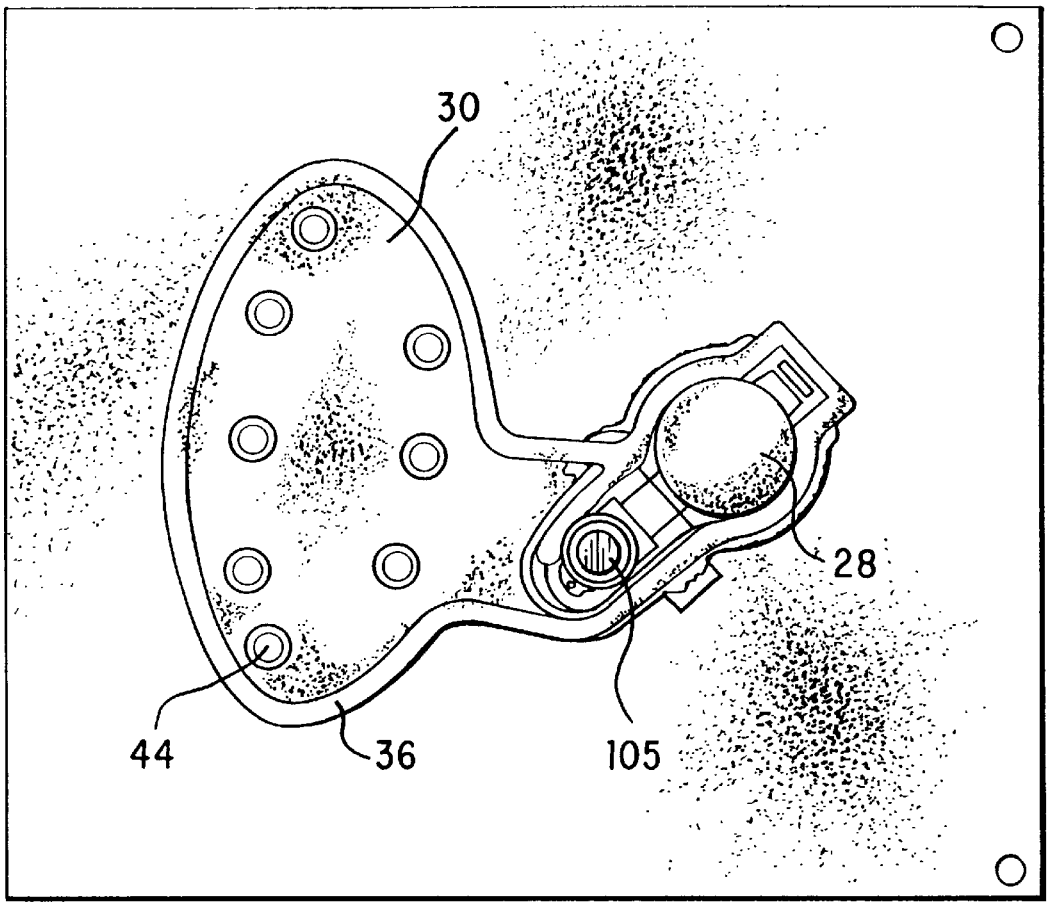
FIG. 26 is an arch bladder of the present invention.
Figure 36:
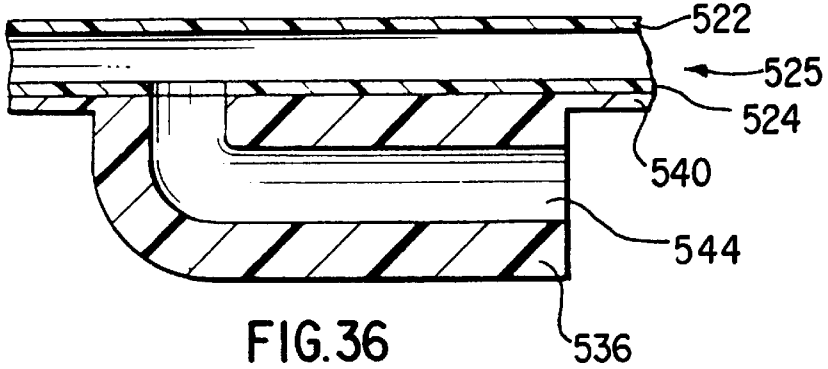
FIG. 36 is a cross section view of the anterior connector used with the present invention.

In yet another embodiment of the invention depicted in FIG. 26, an arch bladder 30 is provided which like previously described bladders utilizes periphery weld lines 36 to attach two sheets of urethane. In FIG. 36, the arch bladder has been welded but is shown prior to die cutting the bladder along periphery weld lines 36. In operation, the bladder 30 of FIG. 26 fits under the arch of the foot and the pump 28 and release valve 94 wrap up the side of the shoe to be conveniently located on the side of the shoe (in a manner similar to FIG. 25).

The foregoing description of the preferred embodiments of the invention have been presented for purposes of illustration and description. It is not intended to be exhaustive or to limit it to the precise form disclosed. Obviously, many modifications and variations may be made in light of the above teachings.

The embodiments were chosen and described in order to best explain the principles of the invention and its practical application to thereby enable others skilled in the art to best utilize the invention in various embodiments and with various modifications as are suited to the particular use contemplated. For example, a bladder may be designed which conforms to parts of the foot other than those parts specified above. In addition, in one embodiment of the invention, a pressure gauge, such as a digital read-out pressure gauge, can be incorporated into the shoe using the present invention to enable a user to consistently add the same air pressure to the bladder. Similarly, a second digital read-out pressure gauge can be used when more than one bladder is used.

Figure 29:
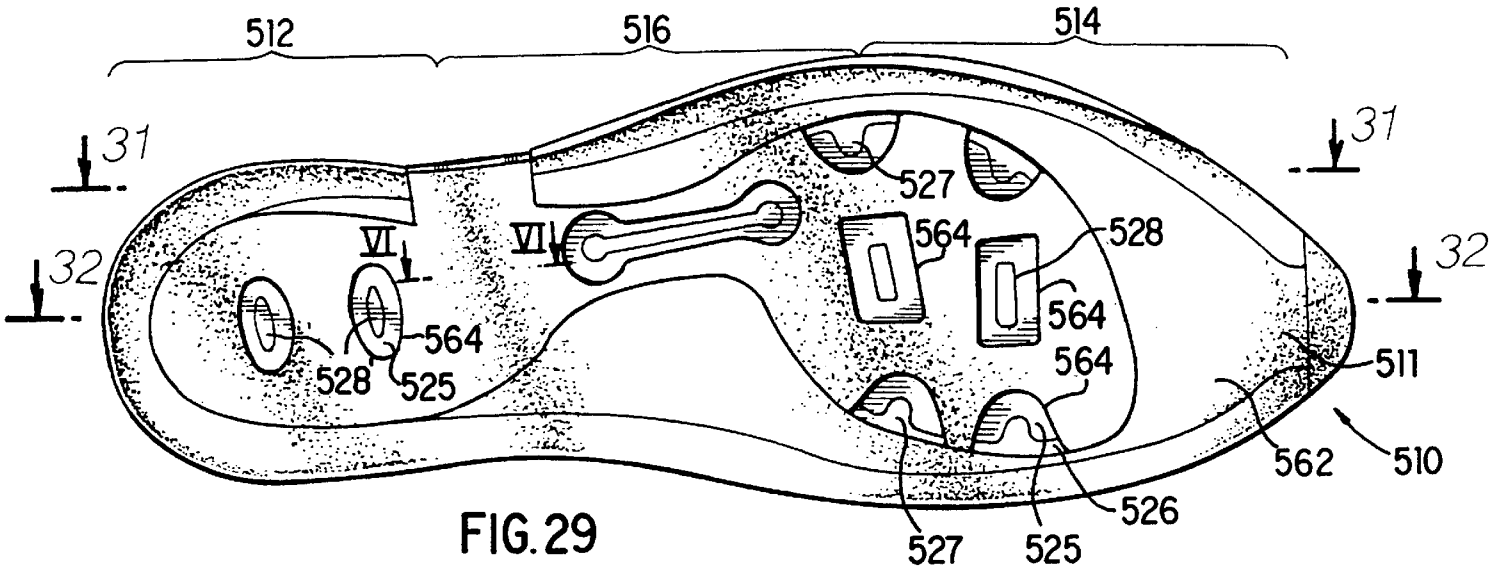
FIG. 29 is a top elevation view of a sole depicting one embodiment of the present invention.

The present invention also provides an underfoot support system which provides improved shock absorption (cushioning) and support. Referring again to the accompanying drawings, FIG. 29 is a top elevational view of an athletic shoe sole incorporating the support system of the present invention. The shoe sole, designated generally as 510, has a heel region 512, a forefoot region 514 and an arch region 516. The heel region of sole 510 generally underlies the calcaneus of the foot of a wearer. Similarly, the forefoot region is generally that region in the anterior most portion of the sole. The forefoot region underlies the metatarsal heads and the region anterior of the metatarsal heads. Similarly, the arch region is that portion of the shoe which generally underlies the arch of the wearer. It should be noted that there are no discrete lines which form the boundaries of the three above-mentioned regions.

FIG. 29 is a sole for use on the left foot of a wearer. The sole for use on the right foot may be a mirror image of that shown in FIG. 29.

The sole of FIG. 29 includes several components: a midsole 511, an inflation bag 525 which lies in a cavity in the midsole; and a foam layer 562. The cavity 558, seen best in FIG. 30, includes a posterior cavity 559, an anterior cavity 560, and a connector cavity 561, which will be discussed in more detail below. The depth of the posterior cavity 559 and the anterior cavity 560 is approximately ⅛ inch and is substantially uniform. Naturally other applications may dictate variations in the dimensions of the cavities. The connector cavity 561 has a depth of approximately ¼ inch. These dimensions can be seen by reference to FIGS. 31 and 32, which are cross-sections of FIG. 29 cut along lines III—III and IV—IV, respectively. The depth of the anterior cavity is designated by $D_a$ and the depth of the connector cavity is designated by $D_c$ Fitting within the posterior cavity 559, and the anterior cavity 560, is an inflation bag 525. FIG. 33 is a depiction of the bottom view of the inflation bag 525 along with a connector body 550. The inflation bag 525 along with the connector body 550 fit within the posterior cavity 559, the anterior cavity 560, and the connector body cavity 561. The system shown in FIG. 33 is inverted and laid on top of the sole 510 shown in FIG. 30.

Figure 32:
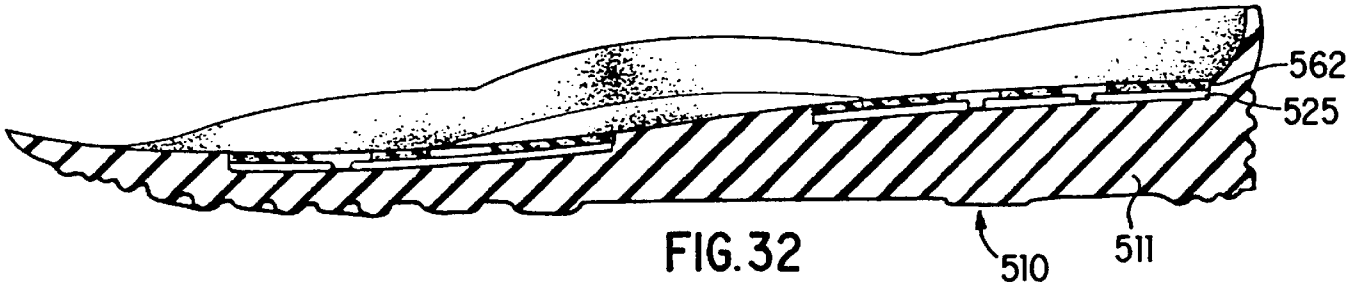
FIG. 32 is a cross-sectional view of FIG. 29 cut along line IV—IV.
Figure 34:
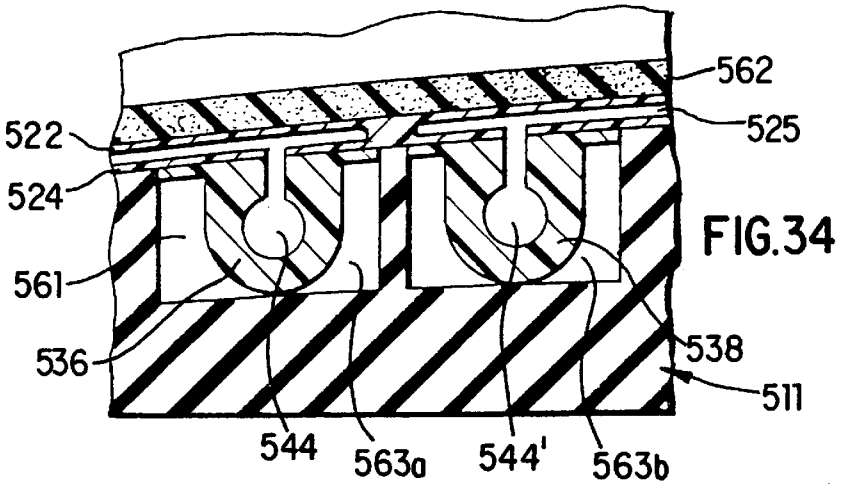
FIG. 34 is a cross-sectional view of FIG. 29 cut along line VI—VI.
Figure 31:
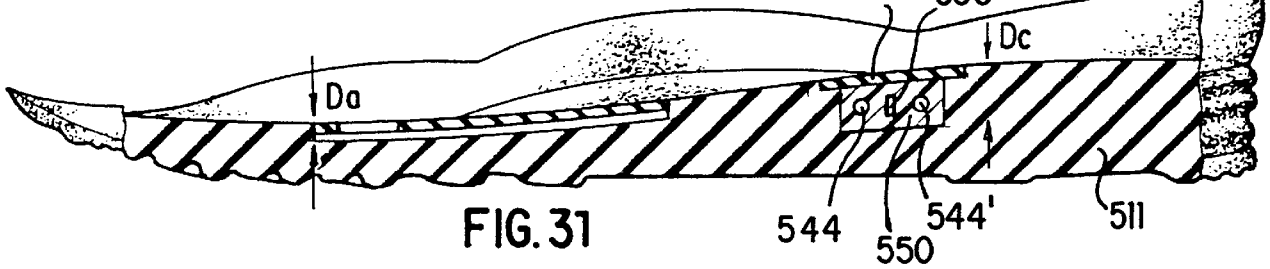
FIG. 31 is a cross sectional view of FIG. 29 cut along line III—III.
Figure 33:
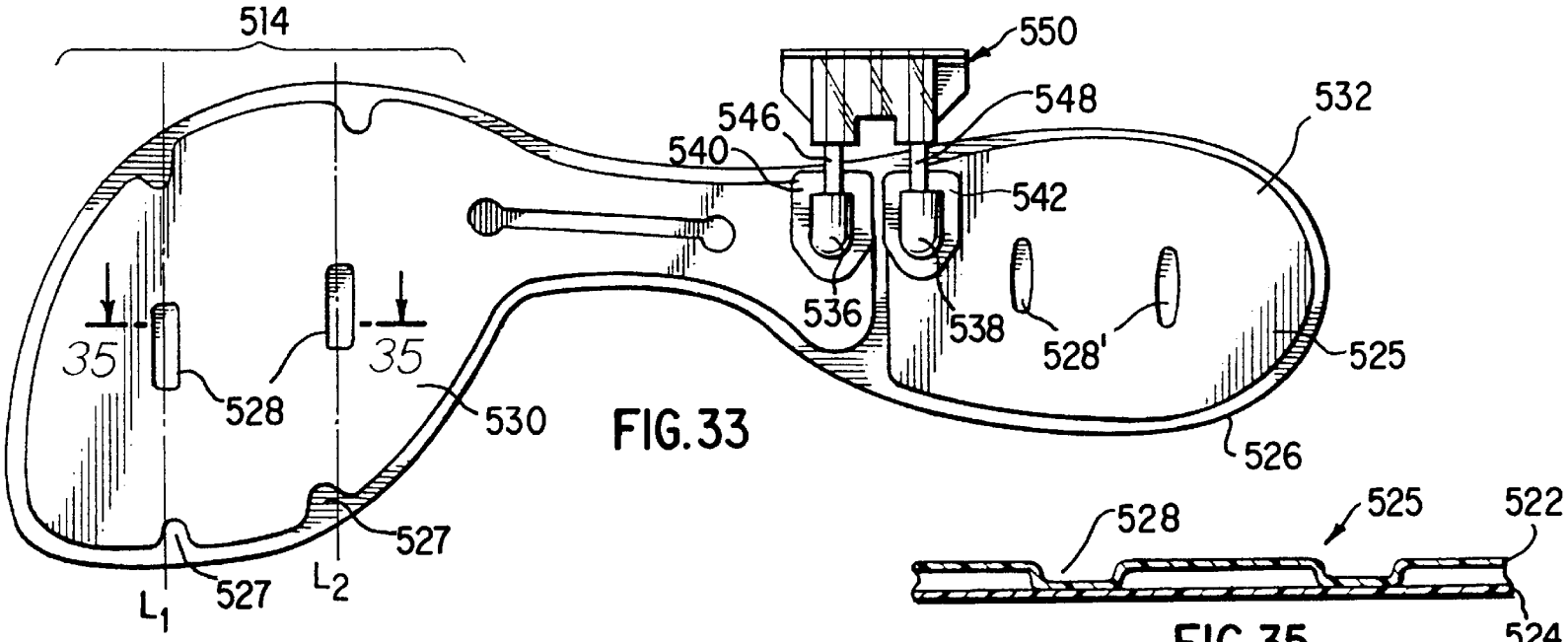
FIG. 33 is a bottom view of an embodiment of the inflation bag of the present invention.

As best seen in FIGS. 31, 32 and 34, the sole 510 forms a plurality of cavities. The sole may be made of any conventional material used for making soles. In particular, the sole may have a midsole 511 formed from a cushioning material and an abrasive-resistant outsole 513. The midsole may be made of a material such as foam PU or EVA and the outsole may be made of a conventional rubber. Lying within a posterior cavity 539 and an anterior cavity 560 is the inflation bag 525.

Referring to FIG. 33, the bottom view of an inflation bag 525 is shown. The inflation bag is formed from a first sheet 522 and a second sheet 524 (see FIG. 35). The first sheet 522 and the second sheet 524 are welded about their periphery with a periphery weld 526. Preferably the sheets forming the inflation bag are made of Pellethane 2355 95 AE available from Dow Chemical Company having a thickness of approximately 19 mils (19/1000 inch). It is preferable that the thickness of the sheets be greater than 15 mil. Interior welds 528 are also provided. The location of the interior welds 528 are selected to function in accordance with the anatomical features of the foot. The two interior welds in the heel region 528' provide a landing zone. To determine the location of the interior welds 528, anatomical landmarks were identified.

Figure 35:
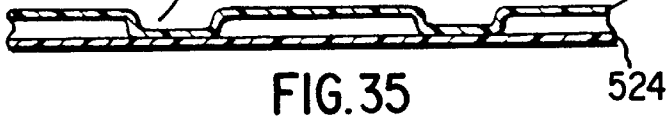
FIG. 35 is a cross-sectional view of FIG. 33, cut along line VII—VII.

Weld notches 527 are provided in the forefoot region 514 to encourage flexing along lines L1 and L2. Flexure is further encouraged by providing flexure apertures 564 in the foam layer 562. These flexure apertures 564, seen best in FIG. 29, overlie all or some of the interior welds 528. In the metatarsal region, flexure is facilitated by the combination of interior welds (preventing inflation) and flexure apertures 524 (decreasing stiffness). Typically when welding two sheets together, one sheet will remain substantially planar while the other will have weld depressions as shown in FIG. 35. It is preferable that the flat sheet (524 in FIG. 35) be the upper surface of the inflation bag 525. Note that because FIG. 33 is a bottom view of the inflation bag 525, FIG. 35 appears to show the upper surface with depressions. It is preferable that the depressions formed by welds 528 be on the lower surface of the inflation bag 525.

With continuing to FIG. 33, a separation weld 534 is provided to separate the inflation bag 525 into an anterior chamber 530 and a posterior chamber 532. Welded to the anterior chamber is an anterior connection 536. Similarly, a posterior connection 538 is welded to the posterior chamber. A first weld flange 540 is provided around the anterior connection 536. Similarly, a second weld flange 542 is provided around the posterior connection 538. FIG. 34 is a cross-section of FIG. 29 cut across the anterior connection 536 and the posterior connection 538. FIG. 36 shows a cross-section of the anterior connection 536. The posterior connection 538 may be identical to that of the anterior connection 536.

The anterior connection 536 defines an interior connection lumen 544, best seen in FIG. 36. The posterior connection 538 defines an interior connection lumen 544'. An anterior tube 546 is inserted in the lumen 544. Similarly, a posterior tube 548 is inserted into the posterior connection lumen.

A connector body 550 is either attached to both the anterior tube 546 and the posterior tube 548 or formed monolithic therewith. The inflation bag 525, the anterior connection 536, the posterior connection 538, and the connector body 550 form a substantially integral unit. In one embodiment of the invention, this unit is a substantially permanently affixed unit which is not intended to be dismantled by the consumer. Naturally, modifications are possible which would allow the consumer to remove and replace component parts.

Figure 30:
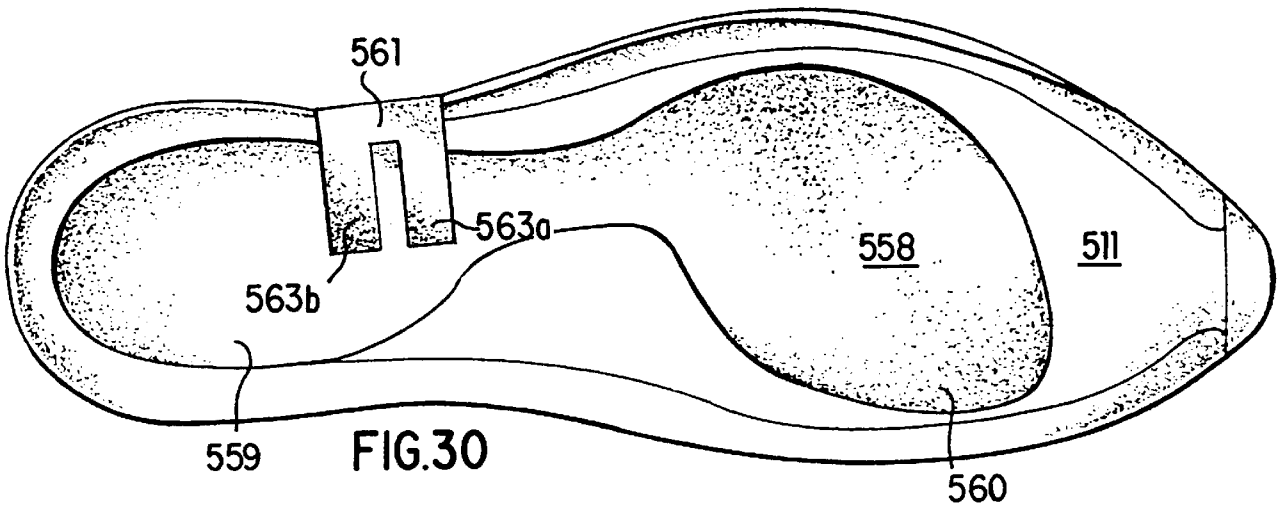
FIG. 30 is a top elevation of a sole without either the inflation bag or the foam layer of the present invention.

As described previously, the inflation system 520 is inserted into the cavities shown in FIG. 30 and is affixed thereto by an adhesive. A foam layer 562 is then adhered to the top of the inflation bag 525. FIG. 29 shows the top view of the sole, the inflation bag 525, and the foam layer 562. It should be noted that the connector cavity 561 has a first hollow **563*a* and a second hollow 563*b* which are intended to accommodate the anterior connection 536 and the posterior connection 538**.

Figure 37:
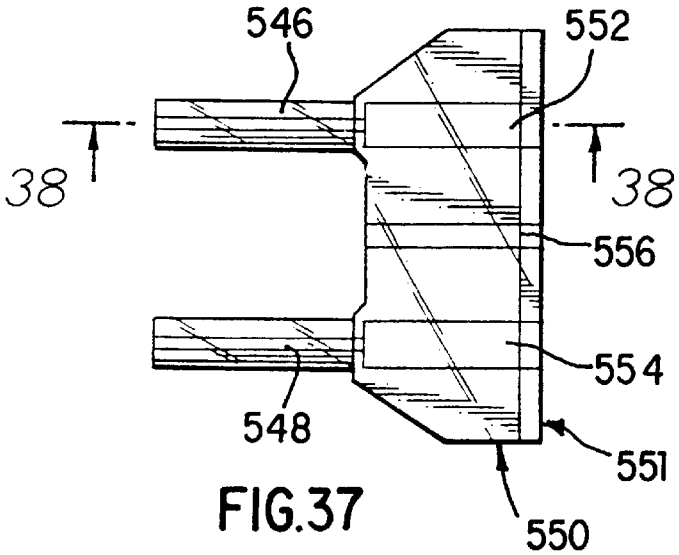
FIG. 37 is a top view of a connector used with the present invention.
Figure 38:
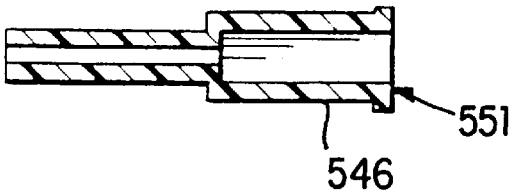
FIG. 38 is a cross section of FIG. 9 cut along line X—X.

Turning to some of the specifics of the connector body 550, and with particular reference to FIGS. 37 and 38 it is anticipated that the front face 551 of connector body 550 would be flush with the exterior of the midsole. The connector body 550 defines an anterior inlet lumen 552 and a posterior inlet lumen 554. The anterior inlet lumen 552 is aligned with the anterior tube 546 and the lumen 544 of the anterior connection to provide a fluid path from the front face 551 of the connector body 550 to the interior of the inflation bag 526. A similar arrangement is provided with respect to the posterior inlet lumen 554. The connector body is provided with a central barb receptacle 556, as will be described in more detail below.

Figure 39:
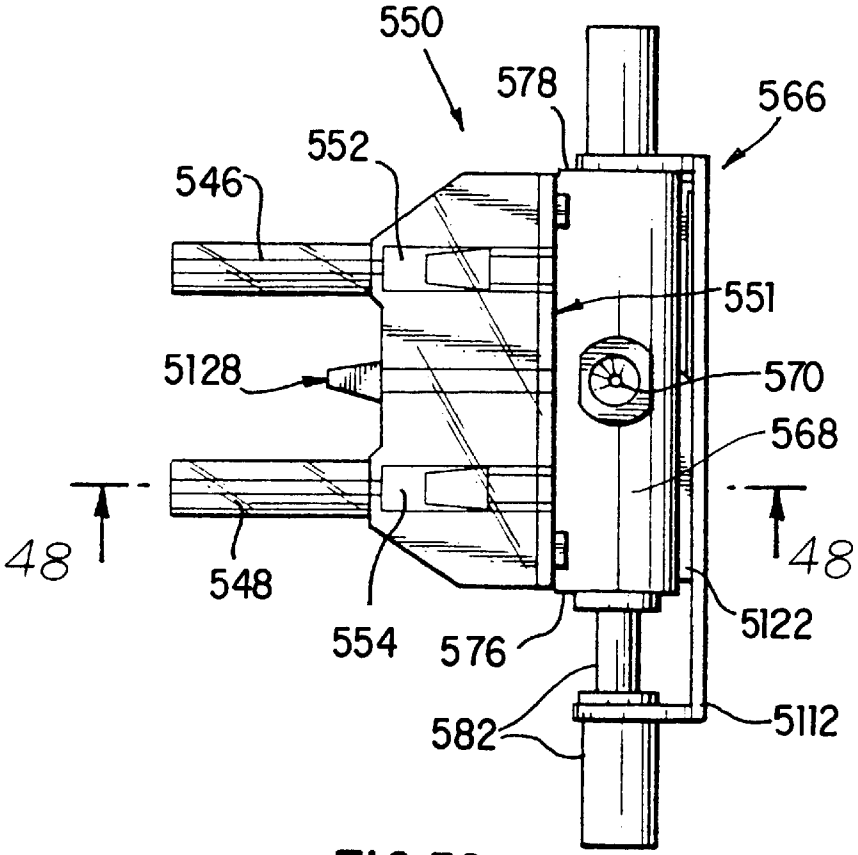
FIG. 39 is a top view of an embodiment of a slider valve attached to the connector of FIG. 37.

Attached to the connector body 550 is a slider valve 566 which selectively allows fluid to be introduced into either the anterior chamber 530 or the posterior chamber 532. FIG. 39 is a depiction of the slider valve 566 attached to connector body 550. A central barb 5128 formed integrally with the slider valve 566 is inserted into and through the central barb receptacle 556. Once inserted, the geometry of the central barb 5128, namely the "arrow" shape of the distal end of central barb 5128, prevents the dislocation of the slider valve 566 from the connector body.

Figure 40:
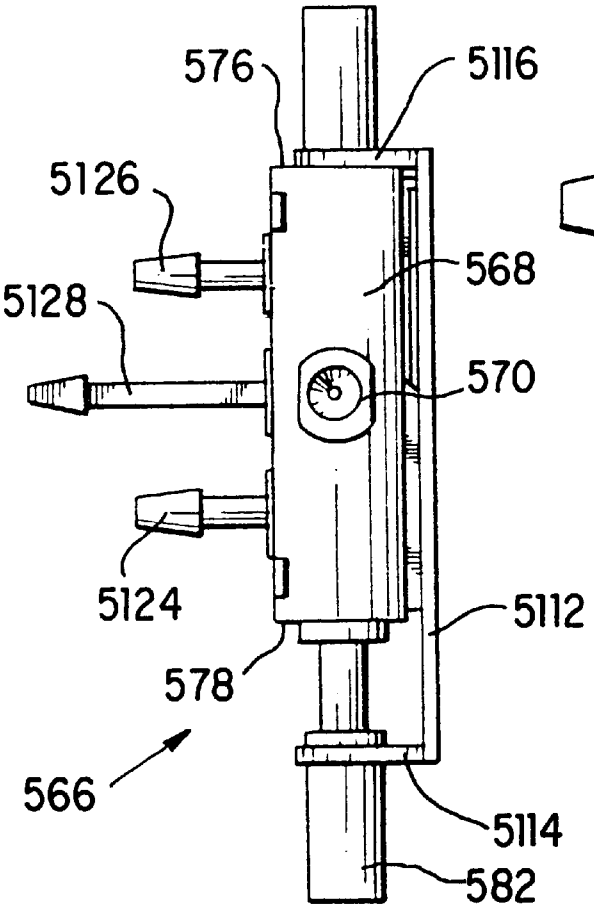
FIG. 40 is a top view of one embodiment of the slider valve of the present invention.

Referring now to FIGS. 40–51, the slider valve for use in the present invention will be described. FIG. 40 is a top view of the entire slider valve 566. As will be described in detail below, fluid enters valve inlet 570 (in the direction into the page in FIG. 40) and selectively exits either the anterior barb outlet 124 or the posterior barb outlet 5126. The barbs are put on the anterior barb outlet and the posterior barb outlet in order to prevent back leakage through the connector.

Figure 41:
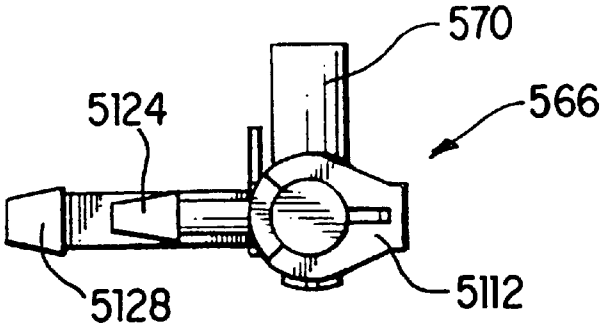
FIG. 41 is a side view of FIG. 40 in the direction of arrow XIII—XIII.
Figure 42:
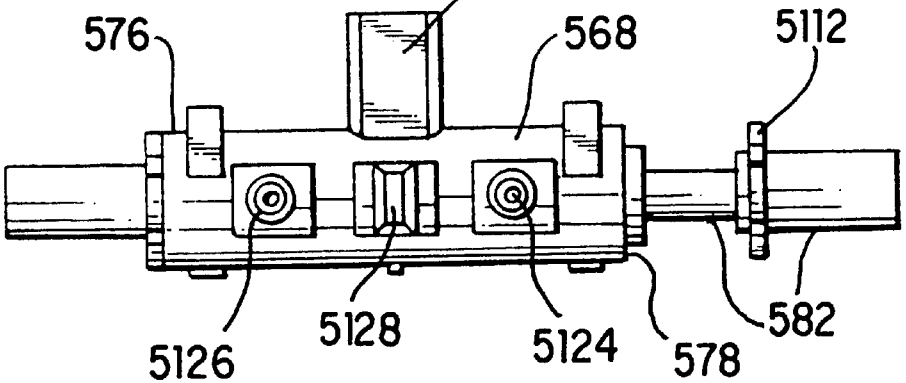
FIG. 42 is a front view of one embodiment of the slider valve of the present invention.
Figure 43:
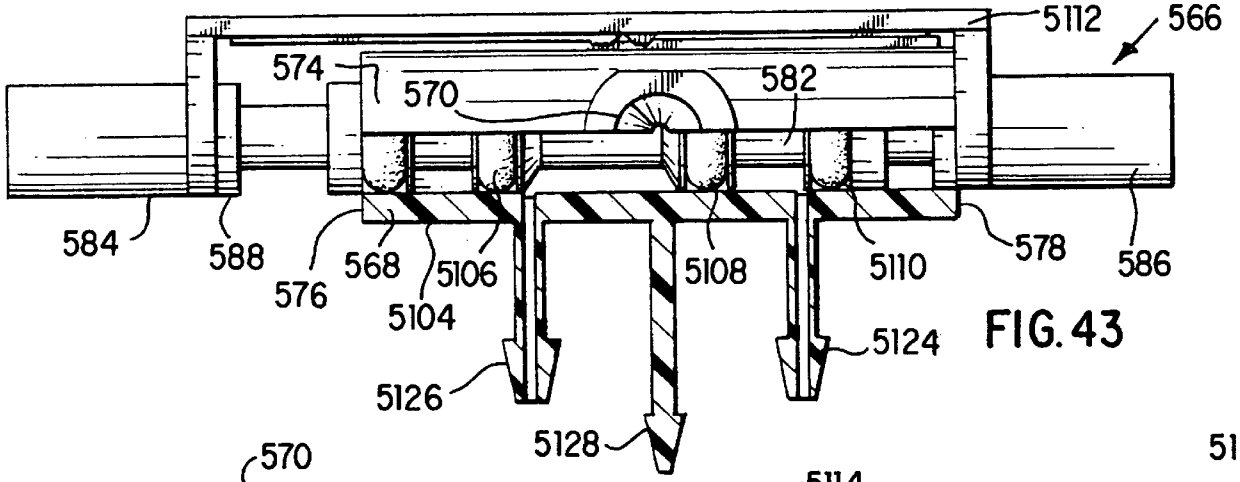
FIG. 43 is a top view of one embodiment of the slider valve of the present invention with a cutaway to show an embodiment of the slider piston of the present invention.
Figure 46:
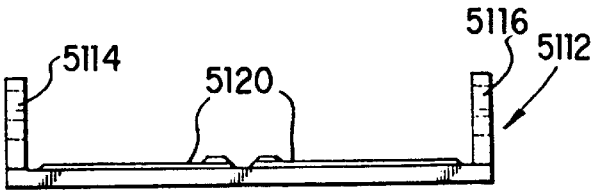
FIG. 46 is a top view of a retaining bracket for use with the present invention.
Figure 45:
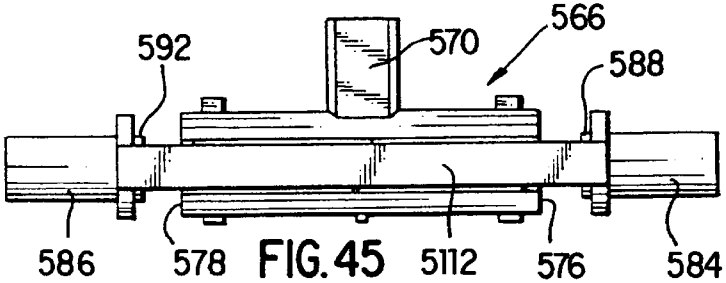
FIG. 45 is a back view of one embodiment of the slider valve of the present invention.
Figure 44:
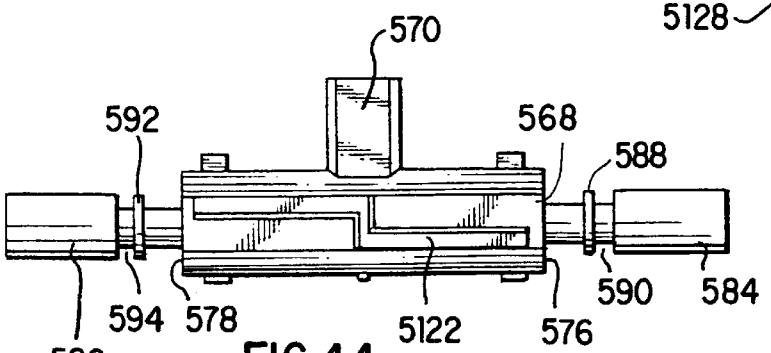
FIG. 44 is a back view of one embodiment of the slider valve of the present invention.
Figure 47:
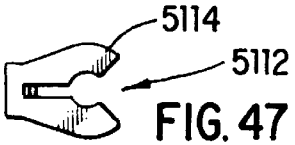
FIG. 47 is a side view of FIG. 46.
Figure 48:
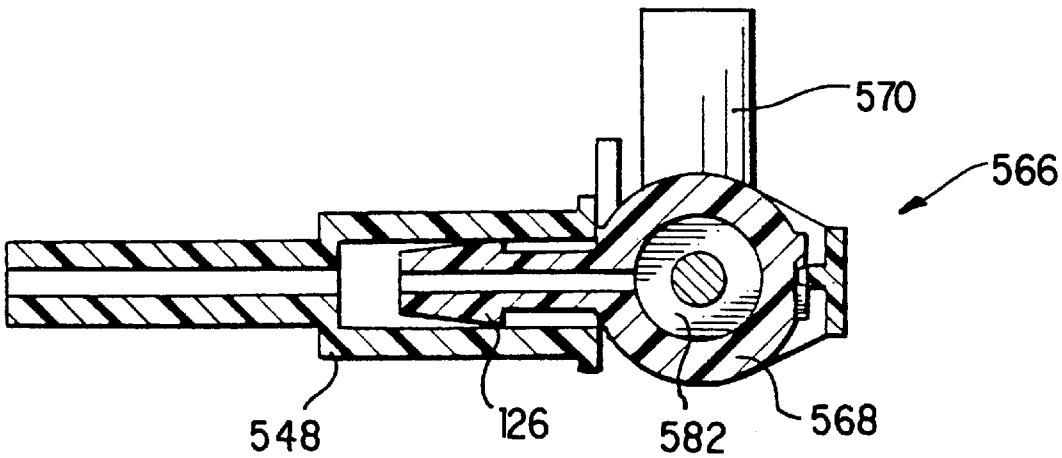
FIG. 48 is a cross sectional view of FIG. 39 cut along line XX—XX.

FIG. 41 is a side view of FIG. 40 in the direction of arrow XIII of FIG. 40 and FIG. 42 is a front view of FIG. 40. FIG. 43 is substantially the same as FIG. 40 except that FIG. 43 has cut away a portion of the valve housing to expose a slider piston 582. In addition, FIG. 43 differs from FIG. 40 in that FIG. 43 shows slider piston 582 and the retaining bracket 5112 affixed thereto selectively moved to a position to allow fluid communication from the inlet 570 to the posterior barb outlet 5126. Conversely in FIG. 40 the slider valve 566 is oriented to allow fluid communication from inlet 570 to anterior barb outlet 5124. FIG. 44 shows the back of the slider valve 566 without the retaining bracket 5112. FIG. 46 shows a top view of the retaining bracket 5112, per se. As will be explained in more detail below, retaining bracket 5112, snaps into a first bracket retaining means 590 and a second bracket retaining means 594 on the slider piston 582. FIG. 47 is a side view of the retaining bracket 5112. As seen in this figure the retaining bracket 5112 is geometrically configured with retaining clamps 5114, 5116 to snap onto the first bracket retaining means 590. Naturally both retaining clamps 5114, 5116 of the retaining bracket 5112 may be configured identically. FIG. 45 is identical to FIG. 44 except that retaining bracket 5112 has been affixed by snapping the retaining clamps 5114, 5116 onto the first bracket retaining means 590 and the second bracket retaining means 594 of the slide piston 582. FIG. 48 is a cross section of FIG. 39 cut along line XX—XX. FIG. 48 shows the attachment of the outlet of the slider valve 566 and the connector 550.

Figure 49:
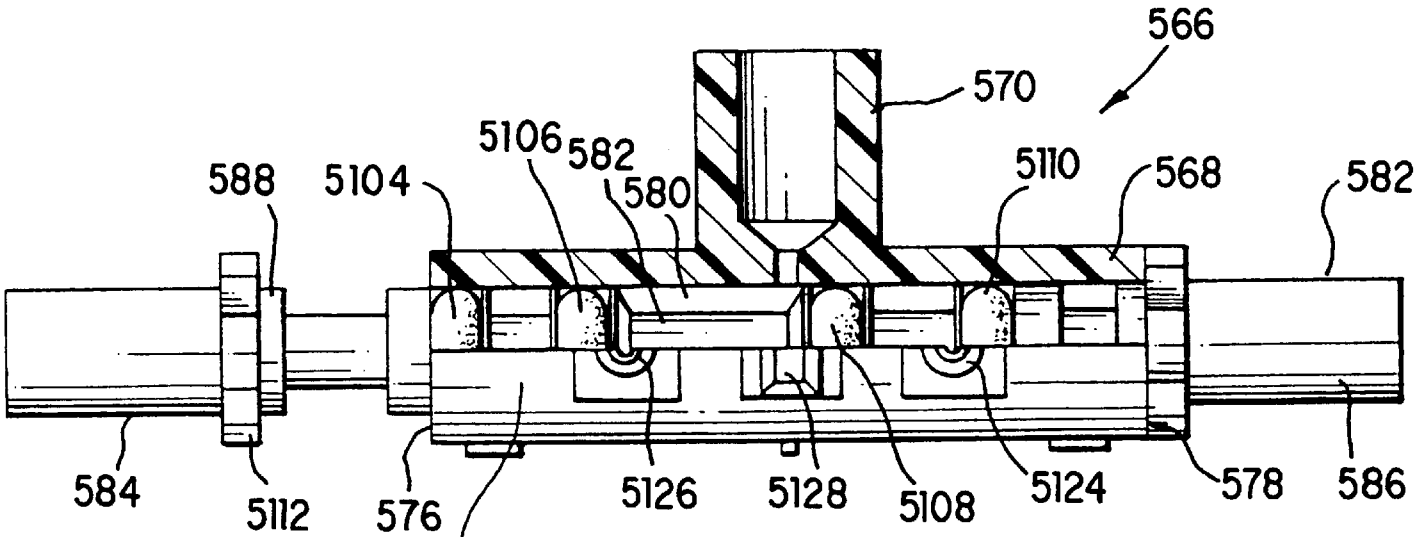
FIG. 49 is a front view of one embodiment of the slider valve of the present invention with a cutaway to show an embodiment of the slider piston of the present invention.
Figure 50:
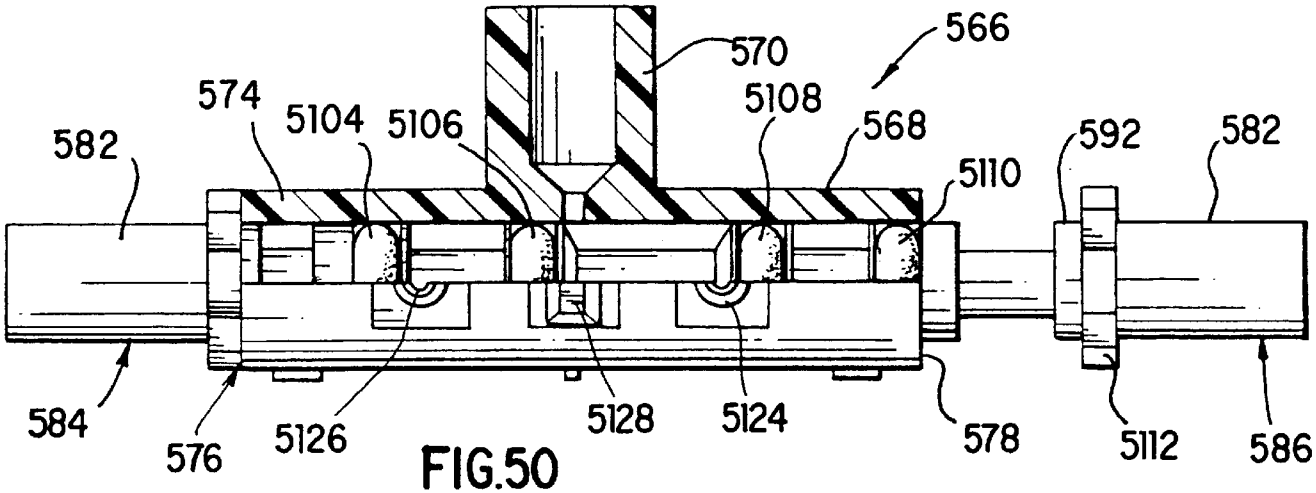
FIG. 50 is the same as FIG. 49 except the valve is set to a different fluid flow path.

FIGS. 49 and 50 depict a cutaway view of the slider valve 566 in its two different positions. FIG. 50 is identical to FIG. 42 except that FIG. 50 has a cutaway portion to see expose slider piston 582.

Figure 51:
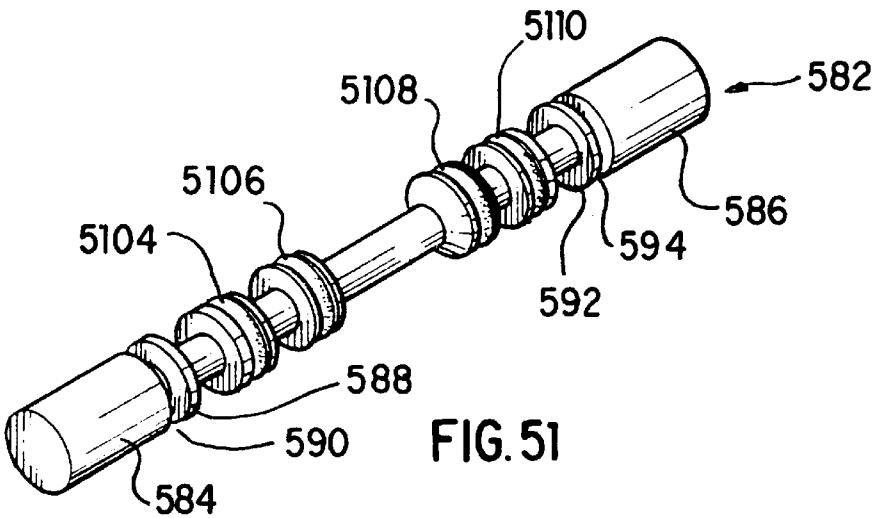
FIG. 51 depicts one embodiment of a slider piston of the present invention.

FIG. 51 shows the slider piston 582 per se. As will be explained, this slider piston 582 is inserted in the central bore 580 defined by the cylindrical body 574 of the housing 568 of slider valve 566. The slider piston 582 may be moved freely along the longitudinal axis of the central bore 580. The retaining bracket 5112 (seen in FIG. 50, for example) defines the extent to which the slider piston 582 moves.

Referring again generally to FIGS. 40–51, the details of the slider valve 566 are herein described. The slider valve, designated generally as 566, includes a housing 568. The housing 568 has a vertically disposed post or valve inlet 570. The valve inlet 570 leads to a generally cylindrical body 574 which has a first end 576, a second end 578, and defines a central bore 580. Disposed within central bore 580 is a slider piston 582. FIG. 51 shows slider piston 582 per se, while FIGS. 43, 49 and 50 show a cutaway of the cylindrical body 574 which shows the slider piston 582 in place. Referring specifically to FIG. 51, the slider piston 582 has a first end member 584 and a second end member 586. The first end member 584 and the second end member 586 have diameters which are substantially the same as the inside diameter of central bore 580, with enough tolerance to allow the slider piston 582 to be moved along the longitudinal axis of the central bore 580. A first annular disk 588 helps define a first bracket retaining means 90. Similarly, a second annular disk 592 helps to define a second bracket retaining means 594.

When the slider valve 566 is assembled, the slider piston 582 is inserted in the cylindrical body 574. A bracket 5112 is then attached to the slider piston 582 as best seen in FIGS. 40 and 43. The bracket 5112, seen per se in FIG. 46, has a first retaining clamp 5114 and a second retaining clamp 5116. The first retaining clamp 5114, a side view of which is seen in FIG. 47, is inserted in the first bracket retaining means 590 while the second retaining clamp is inserted in the second bracket retaining means 594. When the bracket 5112 is attached to the slider piston 582, it is possible to move the piston and attached bracket 5112 back and forth from the position shown in FIG. 49 to the position shown in FIG. 50. The bracket 5112 has projections 5120 (seen best in FIG. 46), which cooperate with projections 5122 on the cylindrical body. The bracket projections 5120 mate with the cylindrical body projections 5122 to inhibit the bracket from moving angularly about the cylindrical body 574. In other words, the bracket 5112 does not rotate relative to either the cylindrical body 574 or the slider piston 582.

FIG. 44 shows the cylindrical body 574 with the slider piston inserted within the central bore 580. FIG. 45 is identical to FIG. 44, except that the bracket has been inserted within the first bracket retaining means 590 and the second bracket retaining means 594. In operation, the slider valve 566 is movable between two positions shown in FIGS. 49 and 50, respectively. When the slider piston 582 is moved to the position shown in FIG. 49, air entering the valve inlet 570 enters the central bore 580 and flows left through a posterior barb outlet 5126. FIG. 43 is identical to FIG. 49, except that FIG. 43 is a top view and FIG. 49 is a front view. As seen in either FIGS. 43 or 49, fluid flows into valve inlet 570 and out of the posterior barb outlet 5126. O-rings 5104, 5106, 5108 and 5110 help prevent leaking and help to assure that the flow is directed in the desired manner. FIG. 50 is identical to FIG. 49, except that the slider piston 582 has been moved along the central bore 580. In the orientation of FIG. 50, fluid flows through the valve inlet 570 and into the central bore 580. Because of the location of the O-rings, the fluid entering the valve inlet 570 exits the anterior barb outlet 5124.

Referring to FIG. 39, the slider valve 566 is shown attached to the connector body 550. The anterior barb outlet 5124 is inserted in the anterior inlet lumen 552 and the posterior barb outlet 5126 is inserted in the posterior inlet lumen 554. A central barb 5128 is inserted in a corresponding central barb receptacle 556 in the connector body 550.

It is intended that once the slider valve 566 has been connected to the connector 550, they will be permanently attached and cannot be disassembled by the user. As will be discussed later, the purpose of the connection is to enable ease of manufacture.

In operation, a latex bulb or the like is used as an inflation mechanism to selectively inflate either the posterior chamber or the anterior chamber. An inflation mechanism, such as the one described in U.S. Pat. No. 5,113,599 (same assignee as the present application), the disclosure of which is herein incorporated by reference, delivers air through a one-way valve to a tube. Other inflation mechanisms such as a molded urethane dome shaped mechanism may also be used to deliver air. Similarly, a portable pressurized gas canister may also be used to deliver gas such as $CO_2$ to the chambers. One end of the tube is attached downstream of the one-way valve, and the other end of the tube is connected to the valve inlet 570. The user may selectively inflate either the posterior chamber or the anterior chamber, depending on the position of the slider piston 582 within the cylindrical body 574.

One of the advantages of the above-described construction is that the upper may be constructed with a substantially permanently affixed inflation mechanism. Similarly, the sole may be constructed. After the sole and the upper are attached, the only additional operation is to insert the barbs of the slider valve 566 into the connector body 550.

In another aspect of the invention, a pressure transducer is placed in the circuit between the mechanism used to inflate the inflation bag 525 and the slider valve 566.

Figures 52, 53, 54:
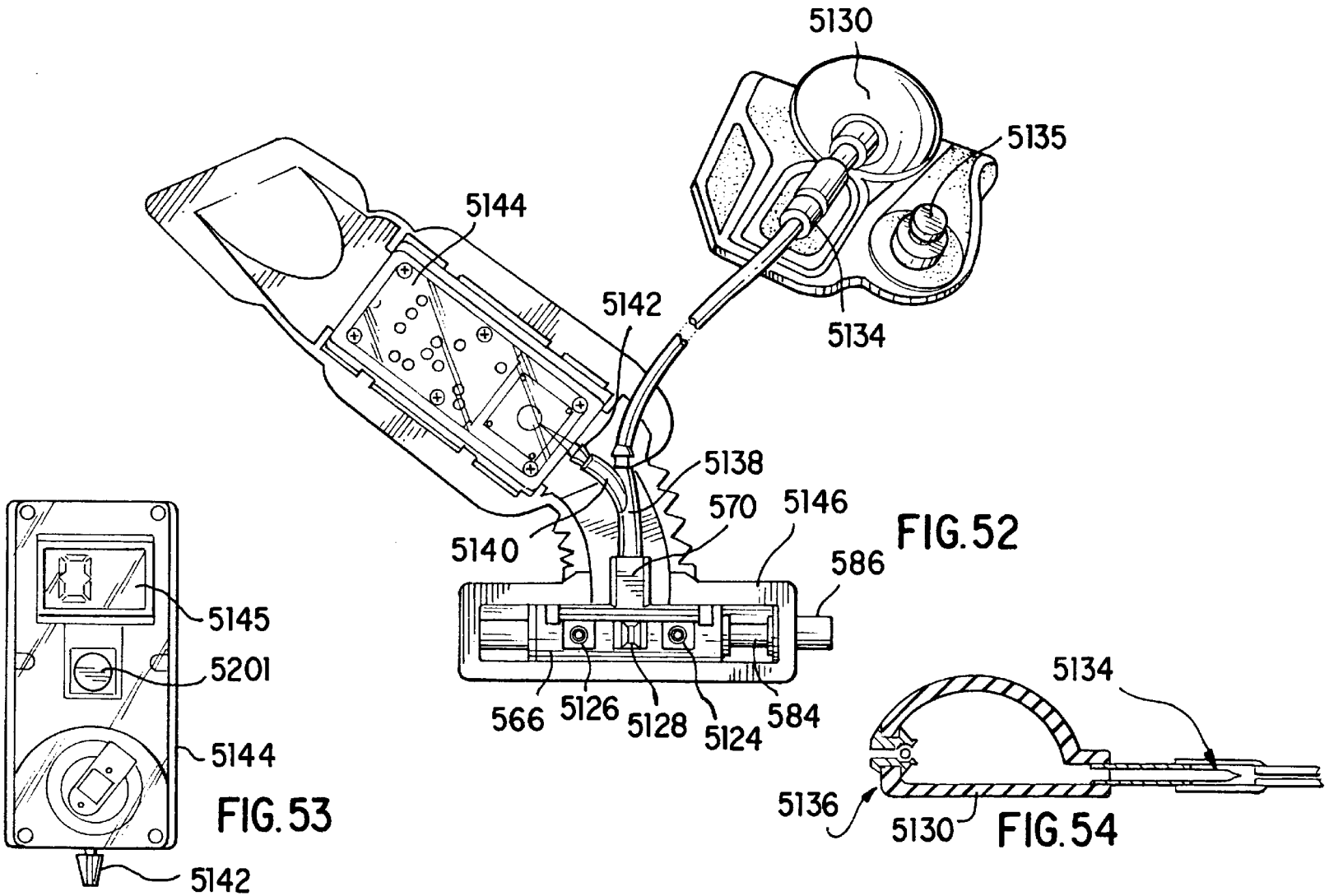
FIG. 52 depicts one embodiment of a slider valve and pressure transducer circuit of the present invention.
FIG. 53 depicts a pressure transducer with digital readout used with the present invention.
FIG. 54 is a depiction of an inflation mechanism used with the present invention.
Figure 55:
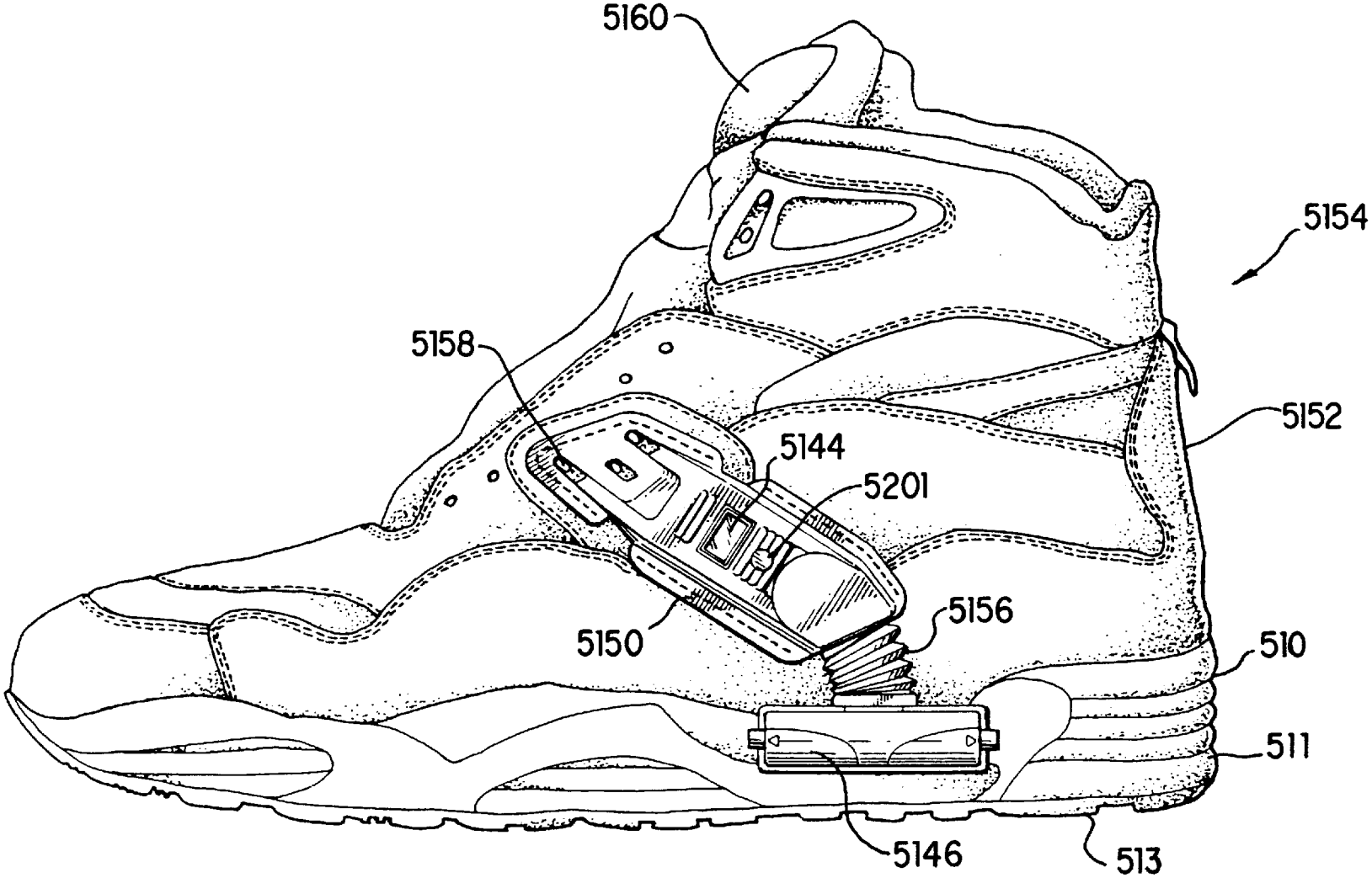
FIG. 55 is a left side view of an athletic shoe incorporating the present invention.

FIG. 52 depicts one possible embodiment of the fluidic circuitry utilized when using a pressure transducer. FIG. 52 shows the system from the back side, i.e., that side not seen in use. FIG. 55, in contrast, shows the system as it appears on a shoe. An inflation mechanism 5130 is depressed by the user, thereby displacing air from the inflation mechanism. A one-way valve 5134 is located downstream of inflation mechanism 5130 to prevent air from returning to the inflation mechanism. One possible one-way valve 5134 is depicted in FIG. 54 (a cross-section of the inflation mechanism and one-way valve arrangement). As seen in this Figure the one-way valve is substantially bill-shaped. This bill-shaped arrangement only allows air to pass through the one-way valve 5134 in the direction away from the inflation mechanism 5130. A second one-way valve 5136 allows ambient air to fill up the inflation mechanism 5130 after the inflation mechanism has been depressed.

A release mechanism 5135 (of the type described in U.S. Pat. No. 5,113,599 is in fluid communication downstream of one-way valve 5134 in order to selectively release air from one or both inflation chambers.

Air which is displaced from the inflation mechanism is passed through delivery tube 5132 to the slider valve 566 via a Y-shaped connector 5138. An arm 5140 of the Y-shaped connector is attached to barb attachment 5142 of a pressure transducer or pressure gauge 5144. The electronic air pressure gauge 5144 may be used to measure the pressure within any of the inflation systems described herein. It may be used whether the inflation system is inflated using an on-board inflation mechanism or an off-board mechanism (such as a pressurized $CO_2$ cartridge). When used in a cushioning system with a diverter valve (slider valve 566), the gauge 5144 measures the pressure in the chamber open to the inflation mechanism.

The gauge is arranged downstream of the inflation mechanisms, and upstream of the actual air bag, it is arranged within the system so that the gauge display can be positioned on the shoe in a location which is easily visible to the user. The tubing connecting the gauge 5144 to the inflation mechanism/inflation system should be kept as short as possible to keep the overall system volume as small as possible, and to limit the volume of the entire system. The gauge should sample at least every 0.8 seconds, often enough to register the increases one would expect to see with each stroke of the inflation mechanism 5130. The display need not display in conventional units such as pound per square inch (psi). The display may be an arbitrary scale created to give the user enough resolution to establish whether the right and left shoes will feel the same as they did when the user last undertook the same activity. In one embodiment, the scale displayed represents pressures from 0 to 30 psi on a 0.0 to 9.5 linear scale with steps of 0.5. It is preferable that the accuracy be at least ±3 psi over a temperature range of 0° F. to 110° F. The electronics must use power efficiently enough to have battery which will outlast the life of the shoe and be smaller than a diameter of approximately 12 mm.

In a preferred embodiment the pressure gauge 5144 has the following characteristics:

1. measuring range: 0–30 psi display range, handles pressure up to 70 psi;
2. readout type: digital LCD which indicates pressure range. Range span 0.0 to 9.5 in 0.5 linear increments. Display should remain illuminated for 60 seconds after the activation button 5201 is released and should sample the pressure at least every 0.8 seconds;
3. accuracy: +−3 psi down to 0° F. and up to 110° F.;
4. storage temperature: −10° F. to 140° F.;
5. battery life: minimum 2 years assuming 4 uses per day every day for 2 years;
6. unit size: 22×43×10 mm;
7. water resistancy: 50 meters water resistancy using watch industry standards;
8. shock resistancy: unit should withstand a meter drop (using watch industry standards) as well as be able to handle vibrational shock of 30 Hz; and
9. weight: approximately 10 grams maximum.

The transducer 5144 (the front of which is shown in FIG. 53) has a digital read out 5145 and may give a pressure read out in real or arbitrary units of measurement. The pressure transducer allows a user to consistently inflate the inflation bag or bags to the desired pressure. The Y-connector 5138 is attached at one end to the valve inlet 570 of slider valve 566. As previously described, air entering the slider valve will inflate either the anterior chamber or posterior chamber of the inflation bag, depending on the position of the slider valve.

In FIG. 52, it can be readily seen that the slider valve is positioned within a valve housing 5146. The ends of the valve housing 5146 have openings which allow the end member 586 to extend therethrough, thereby providing a "button" which can be pushed to move the valve from one position to the next. By pushing the end member 586, the slider piston 582 moves and end member 584 is exposed. Thus, the user can readily select whether to inflate the anterior chamber or the posterior chamber of inflation bag 525.

The pressure transducer is positioned in a transducer housing 5150. As shown in FIG. 55, the transducer housing 5150 may be stitched to the upper 5152 of shoe 5154. An accordion connector 5156 may join the transducer housing 5150 and the valve housing 5146.

Turning specifically to FIG. 55, a shoe 5154 is provided with an upper 5152, a midsole 511 and an outsole 513. The transducer housing 5150, which houses and protects pressure transducer 5144, is stitched to upper 5152 and may provide eyelets 5158 at one end thereof. The inflation mechanism may underlie the inflation mechanism cover 5160 located at the digital end of tongue 5162.

A release mechanism (not shown) for releasing air from the inflation bag may be located anywhere downstream of the one-way valve 5134. U.S. Pat. No. 5,113,599 (previously incorporated by reference) discloses a suitable release valve.

One advantage of the arrangement of the elements as shown in FIG. 55 is that the upper 5152 may be manufactured (along with the inflation mechanism and the slider valve 566) independently of the sole. Similarly, the sole may be manufactured independently of the upper. The upper 5152 and the sole may then be joined in a conventional manner. The central barb 5128 along with the anterior barb outlet 5124 and posterior barb outlet of the slider valve 566 are then inserted into the connector 550 to complete the fluid circuit. The accordion connector 5156 allows for slight variations in the location of the sole relative to the upper without fear of integrity lapses in the fluidic circuit.

Figure 56:
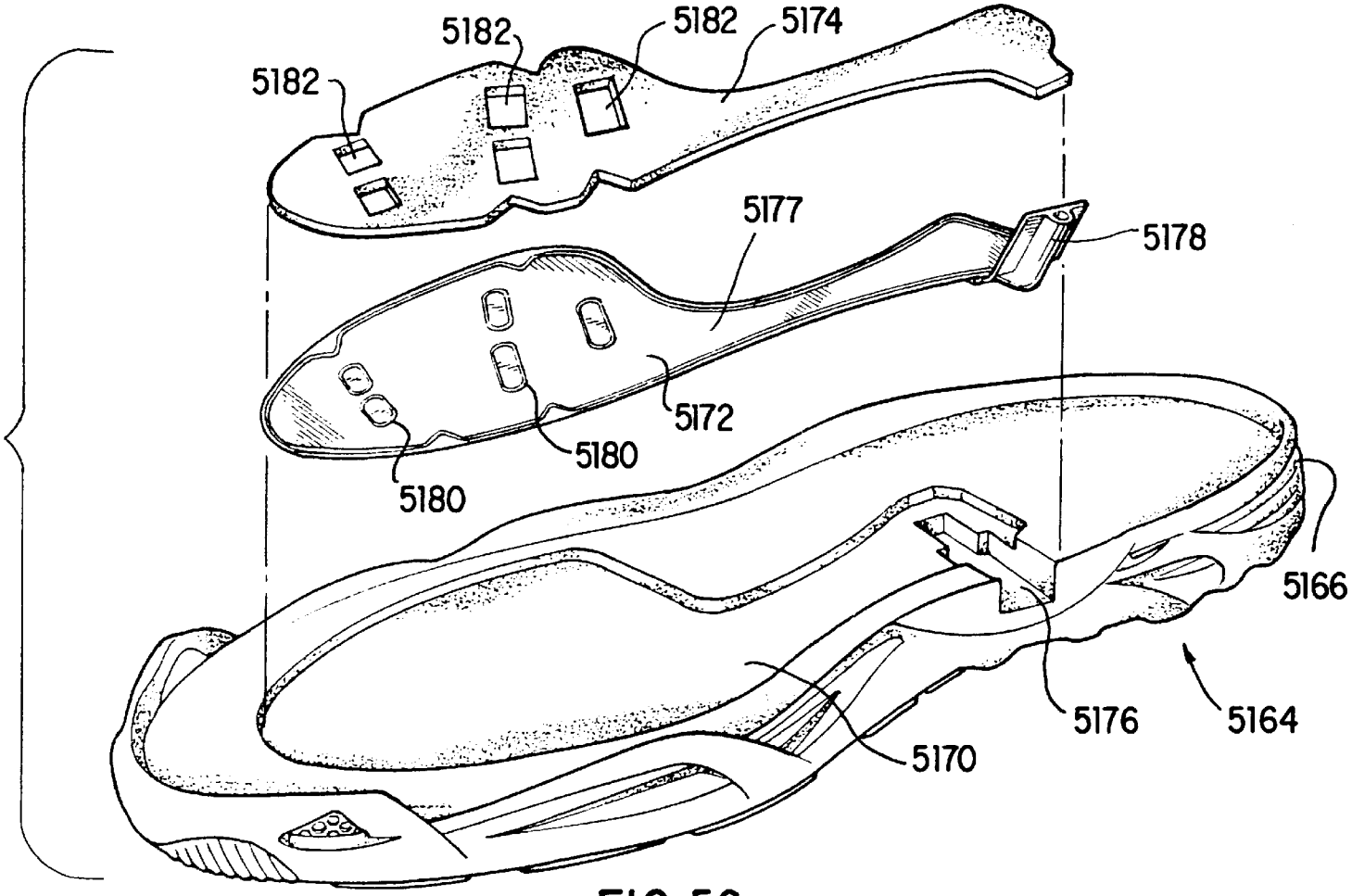
FIG. 56 is an exploded perspective view of a sole incorporating one embodiment of the present invention.

While the invention described above utilizes a posterior chamber and an anterior chamber under the foot of the wearer, in one variation of the invention, an inflation bag having a single chamber is utilized. In this embodiment, shown in FIG. 56, a sole 5164 is provided with a midsole 5166 and an abrasive resistant outsole 5168. A first cavity 5170 is provided with a depth sufficient to accommodate a forefoot inflation bag 5172 and a foam layer 5174. A second cavity 5176 is provided with sufficient depth to accommodate an angled connector member 5178. The angle connector member provides an inlet for inflating the forefoot inflation bag 5177. In one embodiment, the angle connector member 5178 may include a connector such as that which is shown in FIG. 36. The angle connector member 5178 may further include an angle portion as shown in FIG. 56. The angled portion and connector (similar or identical to the one depicted in FIG. 36) may be monolithic or attached via a small tube.

The forefoot inflation bag 5172 is formed in substantially the same manner as the inflation bag described previously having an anterior chamber and a posterior chamber. The forefoot inflation bag 5172 is formed by rf welding together two sheets of material about the periphery of the sheets. The sheets are approximately 19 mil and are made of Pellethane 2355 95AE available from Dow Chemical Company. The characteristic feature of this sheet material is that it initially stretches a slight amount. After the initial stretching, the material is relatively non-stretching.

Within the interior of the forefoot inflation bag 5172 are interior welds 5180 which promote flexing at desired locations. When the two sheets are welded together, a depression is created in one of the sheets (as seen in FIG. 35). It is preferable that the sheet having the depression be the lower sheet. This helps to promote flexing. The foam layer 5176 defines flexure apertures 5182 which completely overlie the area of the interior welds 5180.

In operation, an inflation mechanism, such as the one disclosed in U.S. Pat. No. 5,113,599 is attached via a tube to the angled connector, to selectively inflate the forefoot inflation bag.

Figure 57:
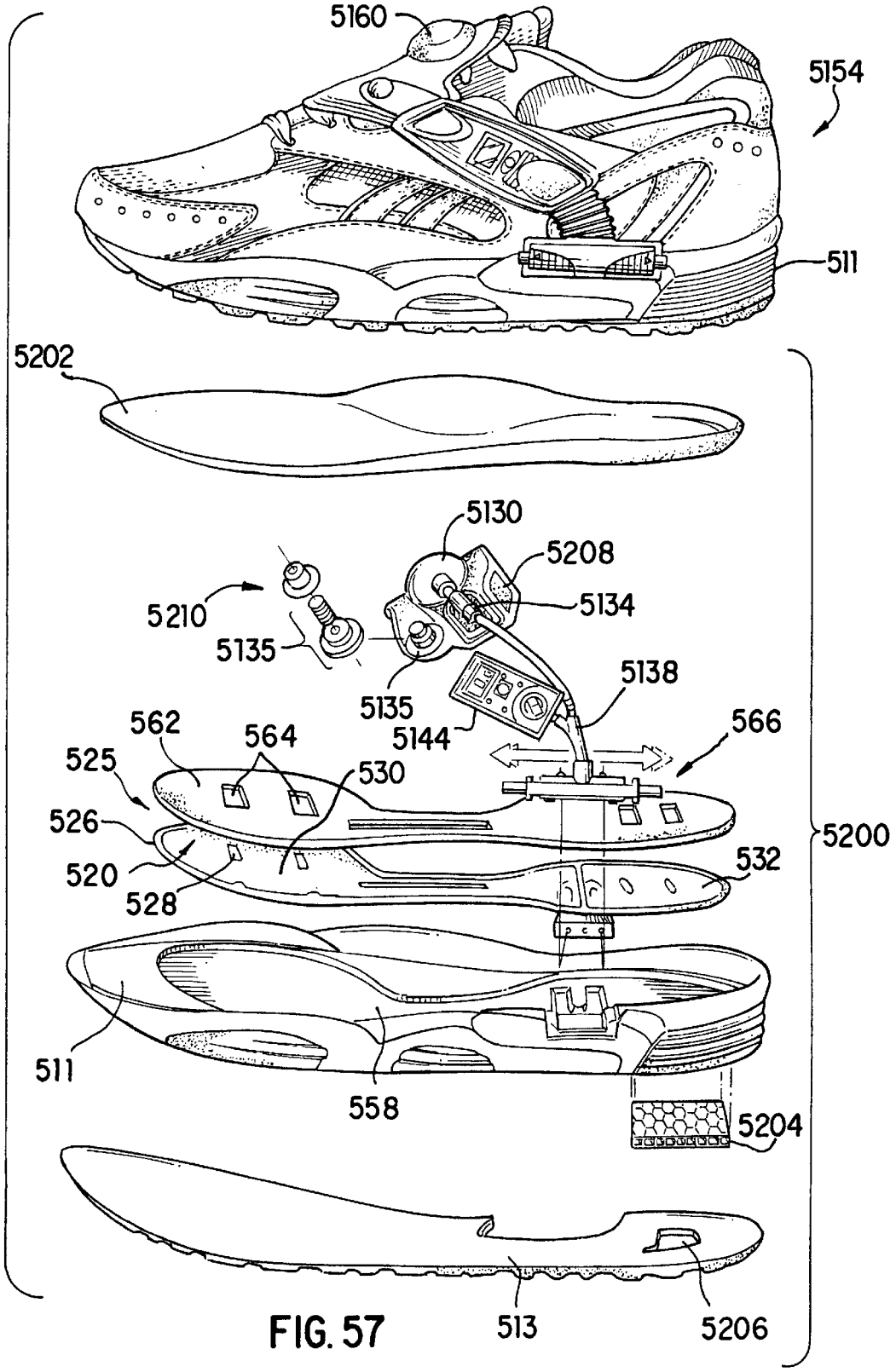
FIG. 57 is a shoe incorporating the present invention and an exploded view of one aspect of the inventor.
Figure 58:
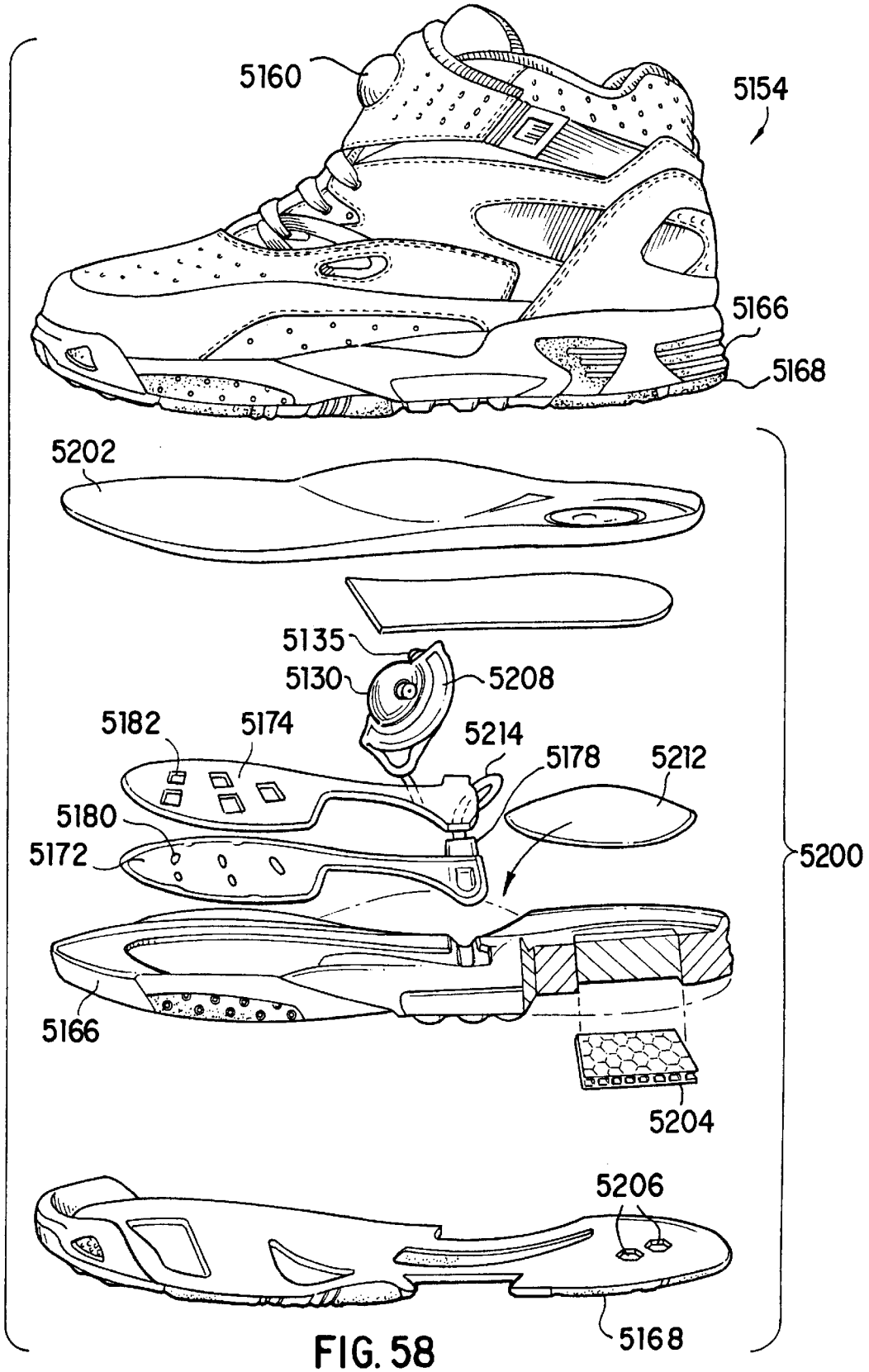
FIG. 58 is a shoe incorporating the present invention and an exploded view of one aspect of the invention.
Figure 59:
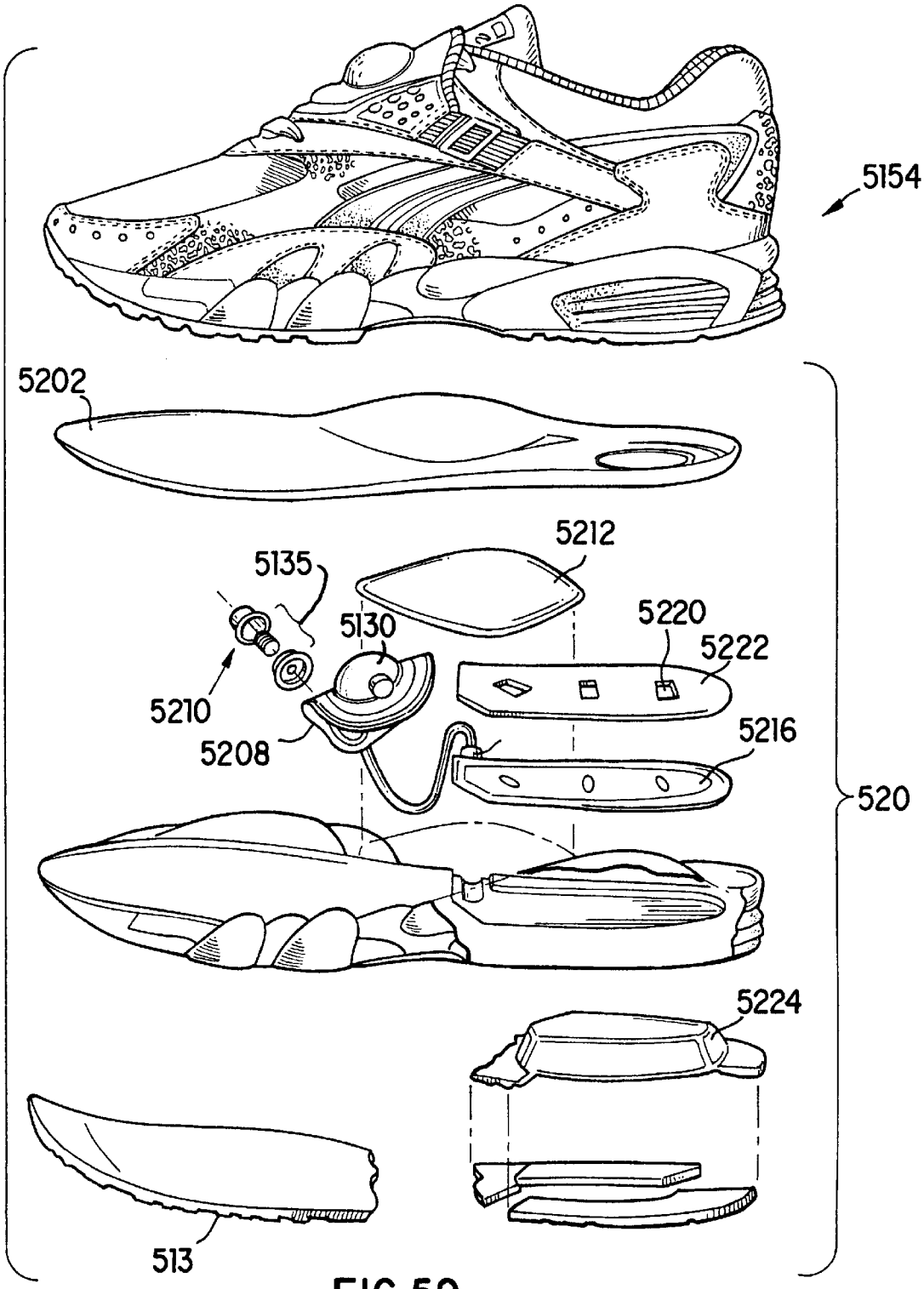
FIG. 59 is a shoe incorporating the present invention and an exploded view of one aspect of the invention.

Referring now to FIGS. 57–59, several implementations of the present invention are shown. At the top of each of FIGS. 57–59 is a depiction of the appearance of the overall shoe 5154 incorporating different aspects of the invention. What lies below the shoe 5154 is an exploded depiction of the inflation system of each shoe and its incorporation with other sole features. The entire underfoot cushioning system along with all the ancillary underfoot components are designated generally as 5200.

The system depicted in FIG. 57 is substantially the same as that depicted in FIGS. 29–54. An exploded view is provided to better show how the components previously described fit together. A conventional sockliner 5202 overlies the system as previously described. As previously described, an inflation system is provided with two chambers and a valve to selectively inflate either the anterior chamber 530 or the posterior chamber 532. Also shown in FIG. 57 is the use of a honeycomb cushioning material 5204 which may be viewed through an opening 5206 in outsole 513.

The release valve 5135 and inflation mechanism 5130 are mounted on a base 5208 which comprises two sheets of film welded together. A passageway may be provided between the sheets to allow fluid communication between the region underlying the release valve and at a point downstream of one-way valve 5134.

A plastic adapter or release valve cover 5210 may be placed over the release valve 5135. The release valve cover 5210 serves two purposes, to protect the release valve 5135 and to act as an adapter to enable the inflation bag 525 to be inflated using a portable gas canister such as a pressurized $CO_2$ canister. Thus, the user has the option of inflating the inflation bag 525 with either the on-board inflation mechanism 5130 or the portable gas canister (not shown). One possible canister and release valve cover 5210 is described in U.S. Pat. No. 5,343,638 and assigned to the assignee of the present invention. The disclosure of this patent application is hereby incorporated by reference.

FIG. 58 depicts another adaptation of the invention. The cushioning system of FIG. 58 is generally the same as that described previously with reference to FIG. 56. An outsole 5168 is provided with openings 5206 for viewing a honeycomb cushioning material 5204. In addition, a foam piece 5212 may be provided to cover the angled connector member 5178. FIG. 58 also shows an inflation mechanism 5130 and release valve 5135 in fluid communication with forefoot inflation bag 5172 via tube 5214.

FIG. 59 shows yet another possible implementation of the invention. This system is similar to the system of FIG. 58 except that a rearfoot inflation bag 5216 is employed. The rearfoot inflation bag 5216 is constructed in substantially the same manner as the previously described inflation bags. Interior welds 5218 are provided in the rearfoot inflation bag 5216 and apertures 5220 are provided in a foam member 5222 overlying the inflation bag 5216. As with other embodiments, an angled connector member 5178 may provide an inlet for air delivered from the inflation mechanism 5130. As with the devices shown FIGS. 57 and 58 a release valve cover 5210 may be provided over a release valve 5135 to enable the rearfoot inflation bag 5216 to be inflated with a pressurized gas canister.

FIG. 59 also shows an outsole 513. A clear rubber dome member 5224 is provided which allows observation of the rearfoot air bag from the bottom of the shoe. The clear dome member 5224 is formed from molded rubber having sufficient optical clarity to view the inflation bag 5216. The molded rubber member 5224 extends from the exterior of the shoe all the way through to the inflation bag 5224. Naturally, a clear member 5224 or similar viewing mechanism may be used in any of the above-described embodiments to view the various inflation bags previously described.

The foregoing description of the preferred embodiments of the invention have been presented for purposes of illustration and description. It is not intended to be exhaustive or to limit it to the precise form disclosed. Obviously, many modifications and variations may be made in light of the above teachings. For example, although the invention has been discussed in the context of athletic footwear, it is possible to adopt the invention for use in other types of athletic equipment such as baseball gloves and other protective equipment; ski boots; helmets and the like.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended thereto.

What is claimed is:

1. An athletic shoe, comprising:

(a) an upper;

(b) a sole, said sole being attached to said upper and including a midsole, said midsole defining a posterior cavity disposed substantially under the heel of a wearer and an anterior cavity disposed anteriorly of said posterior cavity; and (c) an inflation system including:

a posterior chamber formed from a first sheet of material and a second sheet of material, said first and second sheets being welded together to form said posterior chamber, said posterior chamber disposed within said posterior cavity;

an anterior chamber formed from a third sheet of material and a fourth sheet of material, said third and fourth sheets being welded together to form said anterior chamber, said anterior chamber disposed within said anterior cavity;

an inflation mechanism attached to said upper;

a conduit, said conduit having an inlet and an outlet, the inlet of said conduit being oriented to receive fluid from said inflation mechanism;

a slider valve, said slider valve comprising a housing defining a substantially cylindrical bore, said housing having a valve inlet in fluid communication with said outlet of said conduit, a posterior valve outlet and an anterior valve outlet, said valve inlet, said posterior valve outlet, and said anterior valve outlet each defining passageways which are in fluid communication with said cylindrical bore, said slider valve having means to enable the user to selectively block the fluid path to either of said posterior valve outlet or said anterior valve outlet; and (d) a pressure gauge in communication with said inflation system for measuring the pressure of the fluid within said posterior chamber or said anterior chamber.

2. The athletic shoe of claim 1, wherein said means to enable the user to selectively block the fluid path includes a slider piston disposed in said substantially cylindrical bore.

3. The athletic shoe of claim 2, wherein said piston has a plurality of O-rings disposed thereon.

4. The athletic shoe of claim 1, wherein said first sheet of material has a thickness greater than about 15 mils.

5. The athletic shoe of claim 4, wherein said second, third and fourth sheets have a thickness greater than about 15 mils.

6. The athletic shoe of claim 1, wherein at least one of said first, second, third and fourth sheets of material has a thickness of about 19 mils.

7. The athletic shoe of claim 1, wherein said posterior chamber is formed from sheets comprising urethane.

8. The athletic shoe of claim 1, wherein said anterior chamber is formed from sheets comprising urethane.

9. The athletic shoe of claim 1, wherein said inflation mechanism comprises a butyl rubber bulb.

10. The athletic shoe of claim 1, wherein said inflation mechanism is substantially permanently attached to said upper.

11. The athletic shoe of claim 1, wherein said inflation mechanism comprises a pressurized $CO_2$ canister.

12. An athletic shoe, comprising:

a sole unit including a midsole and an outsole;

an upper attached to said sole unit;

an inflatable bladder disposed in the shoe to provide customizable support to the foot of a wearer;

an inflation mechanism for inflating said inflatable bladder, said inflation mechanism being disposed on the shoe and in fluid communication with said inflatable bladder; and means for measuring and indicating the pressure within said inflatable bladder to the wearer of the shoe as said inflatable bladder is inflated, said pressure measuring and indicating means being affixed in fluid communication with said inflatable bladder and disposed on the shoe in a manner which does not impede the wearer's ability to engage in athletic activity.

13. The athletic shoe of claim 12, wherein said inflatable bladder includes two chambers.

14. The athletic shoe of claim 13 further comprising a first valve disposed on the shoe to enable the wearer to selectively block the fluid path to either of said two chambers.

15. The athletic shoe of claim 12 further comprising a second valve disposed on the shoe for releasing fluid from said inflatable bladder.

16. The athletic shoe of claim 14, wherein at least one of said two chambers is located beneath the wearer's foot.

17. The athletic shoe of claim 16 further comprising a foam layer positioned above said at least one of said two chambers.

18. The athletic shoe of claim 16, wherein said at least one of said two chambers is positioned within a cavity provided within said midsole of said sole unit.

19. The athletic shoe of claim 12, wherein said inflation mechanism is integral with said upper.

20. The athletic shoe of claim 12, wherein said inflation mechanism comprises a canister of pressurized $CO_2$.

* * * * *

UNITED STATES PATENT AND TRADEMARK OFFICE

CERTIFICATE OF CORRECTION

PATENT NO. : 5,987,779

DATED : November 23, 1999

PATENTEES : Litchfield *et al.*

It is certified that an error appears in the above-identified patent and that said Letters Patent is hereby corrected as shown below.

In column 28, claim 15, delete "12" and insert --14-- therefor.

Signed and Sealed this

Twenty-sixth Day of September, 2000

*Attest:*

*Attesting Officer*

Q. TODD DICKINSON

*Director of Patents and Trademarks*